US007966782B2

(12) United States Patent
Wood

(10) Patent No.: US 7,966,782 B2
(45) Date of Patent: Jun. 28, 2011

(54) PATIO ENCLOSURE

(76) Inventor: Donald M. Wood, Davison, MI (US)

( * ) Notice: Subject to any disclaimer, the term of this patent is extended or adjusted under 35 U.S.C. 154(b) by 861 days.

(21) Appl. No.: 11/789,092

(22) Filed: Apr. 23, 2007

(65) Prior Publication Data

US 2008/0222991 A1 Sep. 18, 2008

Related U.S. Application Data

(63) Continuation-in-part of application No. 11/116,081, filed on Apr. 27, 2005, now abandoned.

(60) Provisional application No. 60/566,673, filed on Apr. 30, 2004.

(51) Int. Cl.
*E04C 2/52* (2006.01)

(52) U.S. Cl. ..... 52/220.2; 52/241; 52/282.1; 52/293.3; 52/DIG. 17

(58) Field of Classification Search ..... 52/220.2, 52/220.7, 241, 238.1, 300, 301, 282.1, 293.3, 52/DIG. 17
See application file for complete search history.

(56) References Cited

U.S. PATENT DOCUMENTS 546,781 A * 9/1895 Kindl ..... 52/696
2,363,164 A * 11/1944 Waller ..... 52/282.5
3,217,452 A * 11/1965 Steele ..... 52/242
3,310,926 A * 3/1967 Brandreth ..... 52/481.1
3,377,756 A * 4/1968 Polhamus ..... 52/220.7
3,538,660 A * 11/1970 Moor ..... 52/242
3,909,502 A * 9/1975 Lacan ..... 174/494
3,977,149 A * 8/1976 Haynes et al. ..... 52/579
4,891,920 A * 1/1990 Pingston ..... 52/145
5,020,290 A * 6/1991 Hajjar ..... 52/242
5,046,791 A * 9/1991 Kooiman ..... 312/265.1
5,245,803 A * 9/1993 Haag ..... 52/90.1
5,274,974 A * 1/1994 Haag ..... 52/300
5,274,975 A * 1/1994 Haag ..... 52/300
5,277,002 A * 1/1994 Haag ..... 52/90.1
5,685,113 A * 11/1997 Reuter et al. ..... 52/220.7
5,706,620 A * 1/1998 De Zen ..... 52/220.2
5,784,841 A * 7/1998 Nowell ..... 52/220.5
5,848,512 A * 12/1998 Conn ..... 52/837
5,905,229 A * 5/1999 McKitrick et al. ..... 174/495
6,037,538 A * 3/2000 Brooks ..... 174/498
6,047,508 A * 4/2000 Goodman et al. ..... 52/241
6,094,875 A * 8/2000 Laine ..... 52/220.7
6,189,269 B1 * 2/2001 De Zen ..... 52/220.5
6,393,783 B2 * 5/2002 Emaus et al. ..... 52/239

(Continued)

FOREIGN PATENT DOCUMENTS

WO WO 8503098 A1 * 7/1985

*Primary Examiner* — Brian E Glessner
*Assistant Examiner* — Adriana Figueroa
(74) *Attorney, Agent, or Firm* — The Weintraub Group, P.L.C.

(57) ABSTRACT

An enclosed structure, such as a patio enclosure, sunroom, or solarium, is attachable to the exterior wall of a building, has a high proportion of windows and a roof, and constructed from a framework of composite members and insulating wall panels, wherein header and post beams of the room wall assemblies are extruded from material having improved thermal characteristics and stability. Importantly, the beams enable wire services to be routed in concealed fashion from a power source associated with the building to accessible locations in the room and remote to the building. The header and post beams are configured to enable the wire services to be concealed but yet accessible for repair and routing through the header beams and into one or more post beams, as desired.

10 Claims, 15 Drawing Sheets

U.S. PATENT DOCUMENTS 6,664,467 B1 * 12/2003 de la Borbolla ..... 174/503
7,154,052 B2 * 12/2006 Stempinski ..... 174/481
7,223,043 B1 * 5/2007 Andrews ..... 403/363
7,514,485 B2 * 4/2009 Frenkel et al. ..... 524/13
2006/0254167 A1 * 11/2006 Antonic ..... 52/293.3

* cited by examiner 34
56
48
46a
46
50
58
54
52
52a 36
62
62a
60
65
63
66
64a
64

38
72
73
70
70b
72a
72b
69
69a
68a
68
68b 40
80
78a
78
76a
76
77

44
85
86
87
88
84
82
82a

FIG 9
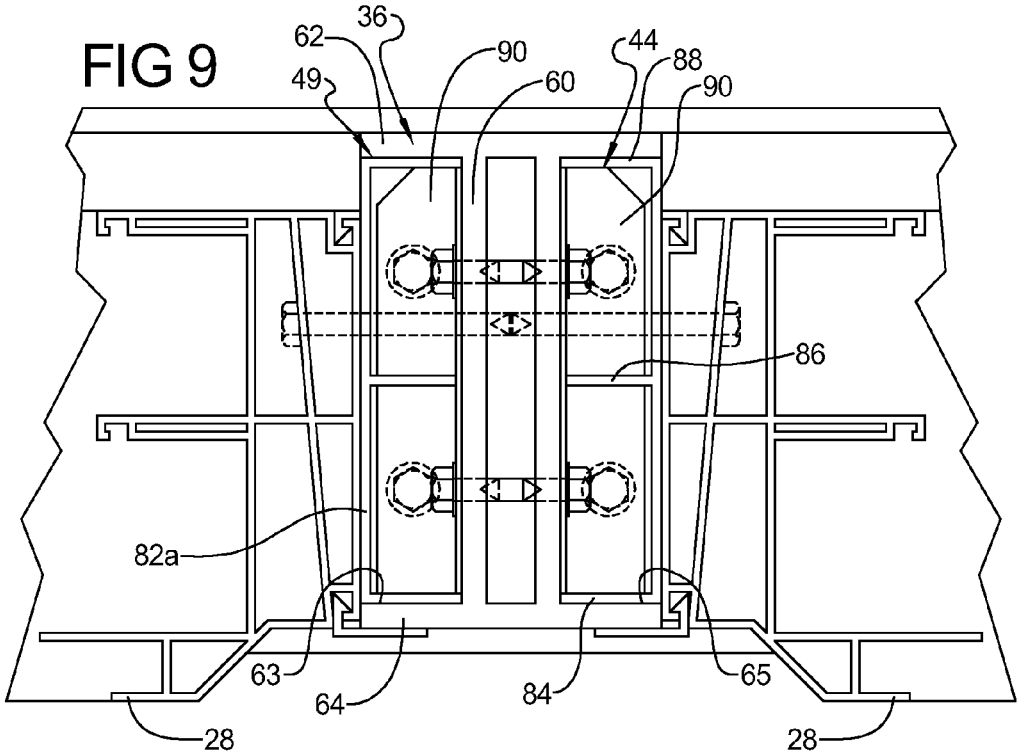
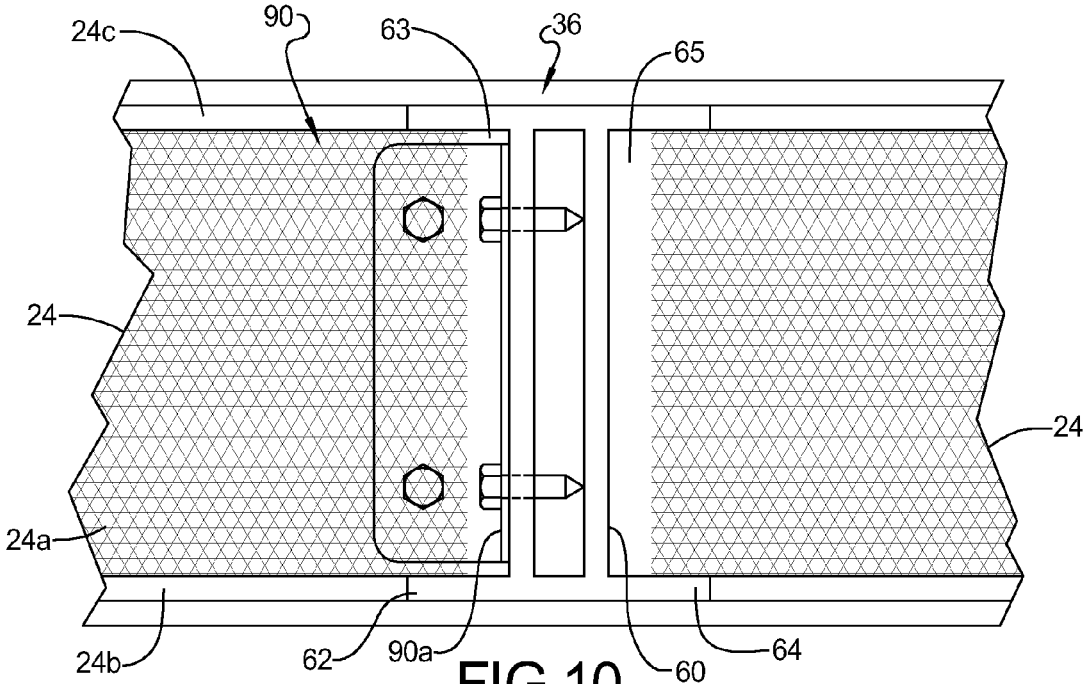
FIG 10

FIG 11
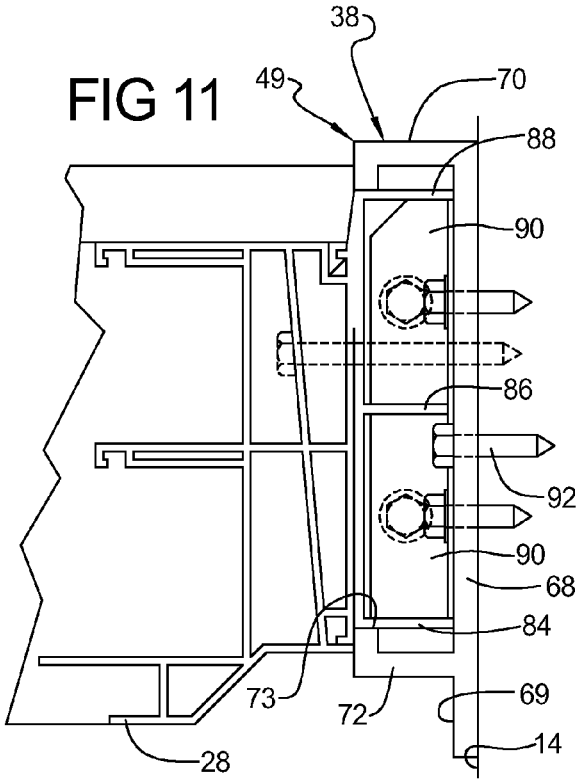
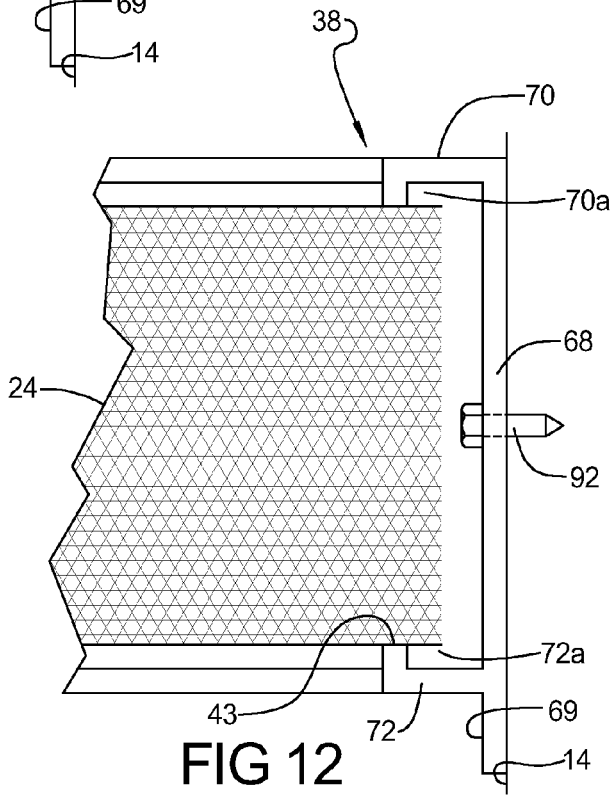
FIG 12

FIG 16
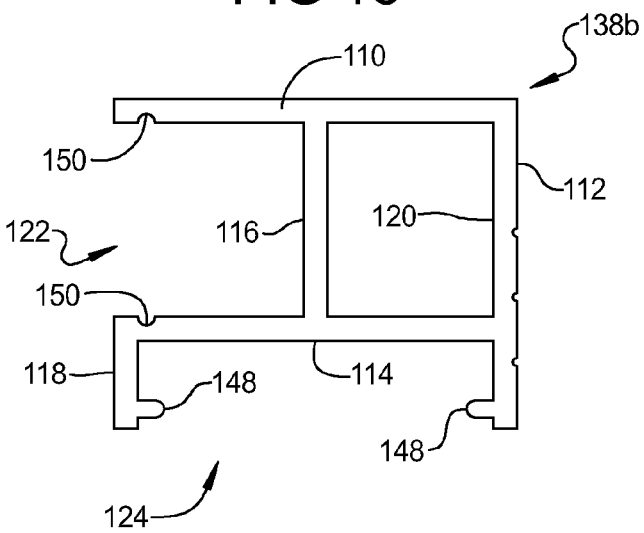
FIG 18
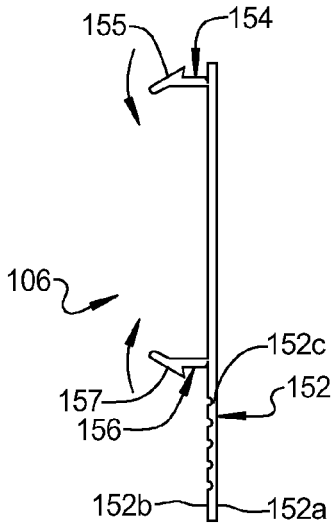
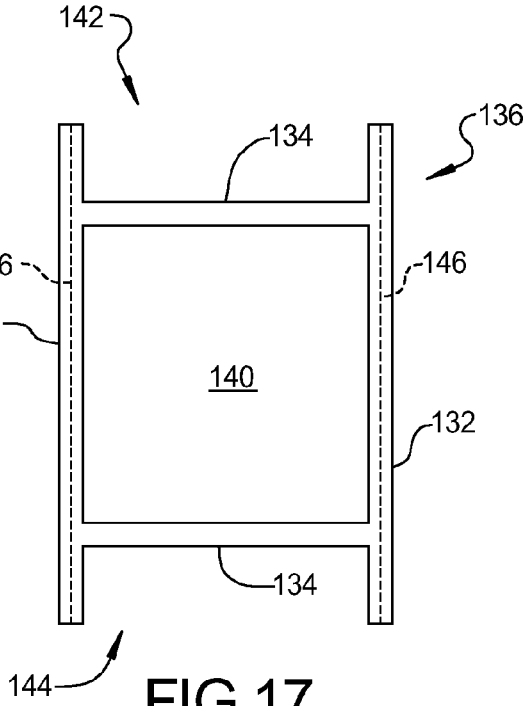
FIG 17
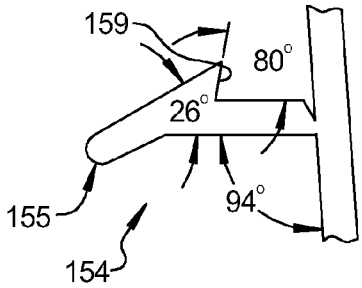
FIG 19

FIG 20
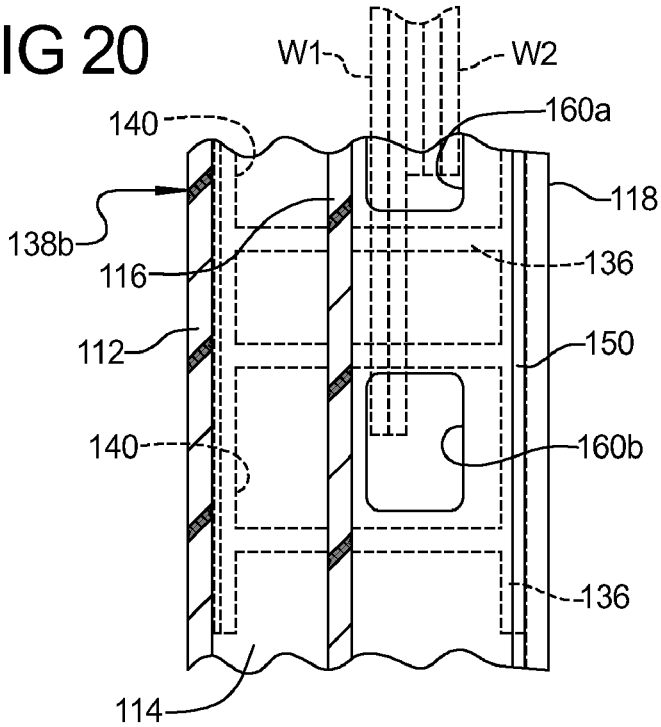
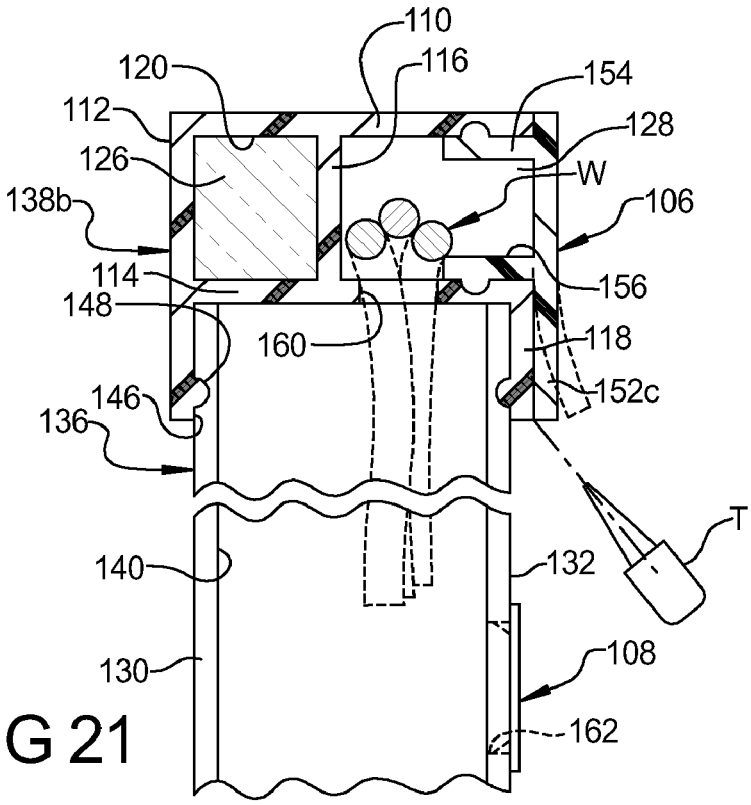
FIG 21

PATIO ENCLOSURE

CROSS-REFERENCE TO RELATED APPLICATIONS

This application is a continuation-in-part of application Ser. No. 11/116,081, filed Apr. 27, 2005 now abandoned, which claims the benefit of Provisional Application Ser. No. 60/566,673, filed Apr. 30, 2004, the entire disclosures of each hereby incorporated by reference.

BACKGROUND OF THE INVENTION

1. Field of the Invention

This invention relates to an enclosed structure that may be attached to the exterior wall of an existing or new building, such structure typically being referred to as a patio enclosure, sunroom, or solarium. More particularly, the invention relates to a patio enclosure having a high proportion of windows and a roof and constructed from a framework of composite members and insulating wall panels. Even more particularly, this invention relates to composite plastic members extruded from material having improved thermal characteristics and stability. Yet even more particularly, the invention is related to beam members used in forming a wall assembly of the enclosure that enables wire services to be concealed, accessed, and routed from the connections at the house to, and for use in, remote areas of the enclosure.

2. Description of Prior Art

Patio enclosures and sunrooms are not new to the building industry. When adding onto or remodeling an existing home or other structure, many people turn to the patio enclosure or sunroom. Such rooms are relatively easy for trained technicians to construct and are inexpensive when compared to other improvements that can be made to a home, such as remodeled bathrooms or kitchens. These enclosures have traditionally been constructed of an aluminum frame with windows or glass sections. Aluminum sunrooms are shaped with vertical walls that have a curved transition to the roof, although most may have a marquee roof or gable type roof.

The following United States patents and patent Publication illustrate various enclosures, non-metallic structural elements used in constructing these enclosures, and the materials used in forming the non-metallic structural elements: U.S. Pat. No. 5,497,594 to Guiseppe et al.; U.S. Pat. No. 5,848,512 to Conn; U.S. Pat. No. 6,003,279 to Schneider; U.S. Pat. No. 6,015,611 to Deaner et al.; U.S. Pat. No. 6,117,924 to Brandt; U.S. Pat. No. 6,248,813 to Zehner; U.S. Pat. No. 6,412,227 to DeZen; U.S. Pat. No. 6,337,138 and U.S. Pat. No. 6,344,504 to Zehner et al.; U.S. Pat. No. 6,460,309 to Schneider; and 2002/0066248 to Buhrts et al.

As discussed in Schneider U.S. Pat. No. 6,003,279 and U.S. Pat. No. 6,460,309, aluminum framed enclosures have several disadvantages. The main problem is poor thermal efficiency. Due to the high rate at which aluminum conducts heat, a room constructed from aluminum cannot stay comfortably cool in the summer, without air conditioning, or warm in the winter, without supplemental heating. This drawback results in dramatically increased cooling and heating costs. Further, a high rate of heat transfer can lead to condensation on the interior surfaces of the aluminum structures. Moreover, many of the windows in aluminum frame type sunrooms are generally installed in such a way that the windows cannot be opened and no screens are present.

Another disadvantage is high maintenance. Aluminum must be painted if chipped and is easily dented. Construction of aluminum rooms is a major disadvantage as well. Because of the nature of the metal, the aluminum pieces must be assembled with external fasteners. External fasteners increase the time of assembly and degrade the overall aesthetics of the room.

In light of these various deficiencies, Schneider U.S. Pat. No. 6,003,279 discloses various structural members, which include reinforced and non-reinforced polyvinyl chloride extrusions, which are joined together at joints using hardware which cannot be seen from inside or outside the enclosure, thereby enhancing the aesthetic appeal of the enclosure. Further, Conn U.S. Pat. No. 5,848,512 and Schneider U.S. Pat. No. 6,460,309 disclose an I-beam that is extruded from plastic and configured such that the vertical spacer wall defines a central passageway that extends between the opposite ends of the beam. Schneider U.S. Pat. No. 6,460,309 is directed to a vinyl roofing system utilizing the channel beam to interconnect roof panels with a roof cap.

In obviating certain of the problems associated with unwanted condensation and thermal conductivity, many framing enclosure designs have used a "sleeve" approach wherein the aluminum elements and sections are enclosed within PVC frames. A drawback to this approach is that the aluminum reinforcing still has to be properly insulated from the rest of the vinyl profile. This approach results in massive, bulky sections with high material costs.

A need continues for a low maintenance sunroom/patio enclosure that is economical, has improved thermal efficiency and minimizes thermal condensation arising from thermal transmittance, provides sliding or double hung windows and/or doorway, has an aesthetic appearance, conceals connecting fasteners, and employs fastening components that are easy to use when erecting the enclosure.

Accordingly, a primary object of this invention is the provision of a sunroom/patio enclosure that obtains the benefits of framing elements and sections of polymeric and like material, and achieves the above noted needs.

Another object of this invention is the provision of a sunroom/patio enclosure using frame elements formed of composite PVC to allow parts to have smaller cross-sections without a great degree of internal reinforcing.

As is known, steel has much lower conductivity to thermal loss than aluminum, and has higher strength properties with lower cost.

Accordingly, another object of this invention is the elimination of most if not all aluminum components from the enclosure product, such as by replacing some frame connecting elements with galvanized steel.

Another object of this invention is the provision of an enclosure structure that shows no screw heads on the inside or the outside of the enclosure room.

A further object of this invention is the provision of an enclosure structure comprised of composite PVC to combine the properties of wood with the maintenance free advantages of vinyl.

A further object of this invention is the provision of an enclosed patio structure and the like, that is built onto an existing building, such as a residential house having connectivity to a source of electricity, cable, phone and like services, and enables wiring from these services to be routed from the house and used in areas of the enclosure remote to the house.

A significant object of this invention is the provision of a wire raceway that enables wires to be routed, in a concealed but accessible manner, from a source operably associated with the house, to a remote area of the patio room.

An aspect of this invention is the modification of beam structure wherein horizontally and vertically disposed header and post beams may be configured to enable a snap-fit interconnection and also a means by which a bundle of like or different wires may be concealed in the beam structure and routed through the header beam and distributed into one or more of the post beams, laterally spaced from one another and in different wall assemblies, and thus provide various services at different locations of the room but remote from the house.

To enable access to the wires, such as for routing, repair, and/or connection to terminal boxes, a removable cover plate is snap-fitted to the header beam to permit easy access to the wires therein and routing the wires therethrough and into and through various of the post beams and one or more removable outlet plates snap-fitted about outlet openings in the post beams.

SUMMARY OF THE INVENTION

Briefly described the objects of the present invention are achieved, in a room structure for attachment to the exterior wall of a building mounted on a foundation adjacent to said exterior wall, said room structure comprising an upright frame assembly having an upper end and formed by at least one enclosure wall and a roof structure extending between said exterior wall and the upper end of said frame assembly, said frame assembly including at least one vertically disposed support member. In particular, an improved room structure according to this invention integrates a wire service raceway into horizontal and vertical header and post beams, the raceway being closable for aesthetic purposes but accessible for appropriately routing one or wires to one or more post beams disposed at different room location.

In a first preferred embodiment according to this invention, there is provided a room structure attached to a building, comprising a wall assembly including at least one horizontally disposed header beam and at least one vertically disposed post beam for supporting the header beam, said header beam and post beam being configured to pass an electrical service wire from the building to the post beam, in an accessible but concealed manner, wherein to provide electrical services to the room structure at a location remote to the building, wherein said post beam includes opposite end portions and closed chamber extending between the ends thereof, said header beam includes opposite and portions and outwardly open first and second channels at right angles to one another, said first channel including an outlet, means for connecting one end portion of the post beam to the second channel to form a right-angled structure with the outlet registered with the chamber, a cover plate for removably covering said second channel to form an closed yet accessible raceway for receiving, concealing and passing said wire, at least in part, through said first channel and into said chamber, and an outlet plate for accessing the chamber, said outlet plate being distal to the one end portion of said post beam to access said electrical wire in the post beam.

In a second embodiment according to this invention, there is provided an improvement in a room structure for attachment to the exterior wall of a building mounted on a foundation adjacent to said wall, said room structure comprising a wall assembly including at least one horizontally disposed header beam and at least one vertically disposed post beam for supporting the header beam, the improvement wherein said header beam and post beam are configured to pass an electrical service wire from the building to the post beam, in an accessible but concealed manner, wherein to provide electrical services to the room at a location remote to the building, wherein said header beam includes a downwardly open first channel and an outwardly open second channel, said channels at right angles to one another, said post beam is generally H-shaped and includes a pair of first wall elements at right angles to a pair of second wall elements, the wall elements forming outwardly open third and forth channels and a central box chamber that extend between upper and lower end portions of the beam, wherein one of said third and fourth channels is adapted to receive the edge of a wall panel of said wall assembly and one of said end portions is received in the downwardly open first channel of said header beam, first means for covering said second channel to form a concealed raceway for receiving and passing said wire, at least in part, second means for removably connecting said one end portion of said post beam to said header beam, and third means for passing electrical services from the header to the other end portion of the post beam.

According to the improved room structure, said second channel is formed, at least in part, by upper and lower wall elements, and said first means for covering comprises a cover plate, said cover plate being coextensive with the outwardly open second channel and including a pair of resilient fingers, each finger having a free end that is spaced from the plate and interfittable within said second channel, and one and the other of said pairs of fingers and said pair of wall elements having a locking hook and locking recess that interlocks with a locking hook when the fingers are interfitted within the second channel.

The first means comprises said cover plate being removably connected to the header, said cover being generally planar and vertically disposed in parallel spaced relation to the wall assembly when connected to the header and including an upper closure portion, from which the fingers extend, and a lower skirt portion, juxtaposed with the wall assembly, removal of the cover plate being effectuated by insertion of a tool in the space between the skirt portion and the wall and urging the skirt portion away from the wall assembly and the fingers from latched engagement with the lock recesses.

The third means comprises the second channel including an opening, wherein connection of the header beam and the post beam registers the opening with the box chamber to enable a service wire to pass through the header and downwardly through the box chamber of the post beam.

The second means for removably connecting comprises a pair of locking grooves provided in the downwardly open first channel of the header beam, and a locking rib formed on each said first wall element, insertion of the end portion of the post beam into the first channel causing the locking grooves and locking ribs to snap fit into engagement with one another.

In a third embodiment according to this invention there is disclosed an improvement in a room structure for attachment to the exterior wall of a building and adapted for use with a power source associated with said building, said room structure comprising a frame assembly including a horizontally disposed header beam, a vertically disposed post beam having upper and lower end portions, a wall panel connected to the header and post beams to form, at least in part, a room closure, the improvement comprising means for concealing and routing a service wire from said building to an area of the room structure remote to the building, said wire having rearward and forward ends with the rearward end thereof connected to the source, said means for concealing and routing comprising said post beam including a closed chamber for receiving a portion of said wire and positioning the forward end of said wire proximate to the lower end portion of said post beam, said header beam including an outwardly open first channel for receiving and passing a portion of said wire proximate to the rearward end of said wire, a downwardly open second channel for receiving and fitting atop the upper end portion of said post beam, and an outlet for passing a medial portion of said wire between the second channel and into the closed chamber of said post beam, first means for removably connecting the upper end portion of said post beam to said header beam, a cover plate, second means for removably connecting said cover plate in covering relation with said outwardly open first channel to form a closed raceway for passing and concealing a portion of said wire, removal of said cover plate exposing and providing access to the wire portion therein, and third means for accessing the forward end portion of said wire in said box chamber.

According to this improvement, said first channel includes a pair of wall elements that form an outwardly open U-shape, and said second means comprises said cover plate including a pair of resiliently deflectable latch fingers adapted to be received in said first channel, wherein one and the other of each of said wall elements and each of said latch fingers, respectively, includes a latch hook and a lock recess adapted to engage in a respective lock recess.

Further and according to this improvement, said post beam includes respective pairs of spaced apart first and second wall elements that combine to form an H-shape and the box chamber, said second channel is formed by a pair of laterally spaced third wall elements that form a downwardly open U-shape sized to fit about and receive the upper end portion of the post beam with the third wall elements of said header beam in juxtaposed relation with the first wall elements of said post beam, and said first means comprises one and the other of each of said third wall elements and said first wall elements, respectively, includes a groove and a rib, wherein the ribs are adapted to interlock with the grooves when the post beam is fitted into the second channel.

Further and according to this embodiment, one of said third wall elements that forms the second channel of said header beam includes an interior face that is juxtaposed against one said first wall element of said post beam and an exterior face, and said cover plate includes an upper first portion and a lower second portion, wherein the upper first portion is disposed in covering relation with the outwardly open second channel and the lower second portion is disposed in covering relation with the exterior face of the header beam when the cover is connected thereto.

Additionally, said third means includes an opening in one or the other of said first wall elements proximate to the lower end portion of the box beam and in communication with the chamber thereof.

BRIEF DESCRIPTION OF THE DRAWINGS

These and other objects, advantages and features of the invention will become apparent from the following description taken in conjunction with the accompanying drawings, which illustrate specific embodiments of the invention. In the drawings:

FIG. 9 is a section view of the front wall taken along line 9-9 of FIG. 2 showing two window channels separated by an H-beam, and a pair of L-shaped flanges and a pair of E-shaped filler channels interfitted into oppositely facing outwardly open channels of the H-beam, the flanges for connecting the H-beam to the a track member, and thus to the ground structure;

FIG. 10 is a section view of the front wall taken along line 10-10 of FIG. 2 showing opposite edges of front wall panels and an L-shaped flange for connecting the beam to the ground structure interfitted into oppositely facing outwardly open channels of the H-beam;

FIG. 11 is a section view of the right side wall taken along line 11-11 of FIG. 4 showing a C-shaped track member connected to the exterior wall, a window channel, and an E-shaped filler and an L-shaped flange interfitted into an outwardly open channel of the track member;

FIG. 12 is a section view of the right side wall taken along line 12-12 of FIG. 4 showing a track member disposed vertically and connected to the exterior wall and a vertical edge portion of an enclosure panel interfitted into the track member;

FIG. 16 is an end view of the header beam, FIG. 17 is an end view of the post beam, FIG. 18 is an end view of the closure cover, FIG. 19 is an enlarged view of a portion of a spring finger of the closure cover of FIG. 18, FIG. 20 is a section view taken along line 20-20 of FIG. 15 showing spaced apertures formed in a wall element of the header beam for routing electrical wiring services extending along and through the header beam into a post beam; and FIG. 21 is an elevation view, partially in section, showing the horizontal header beam assembled atop a vertical post beam and electrical wires routed horizontally through a passageway in the header and vertically downwardly through the center of the post beam for connection to a service outlet in the lower end portion of the post beam.

DETAILED DESCRIPTION OF THE PREFERRED EMBODIMENTS

Referring to FIGS. 1 and 2-4 there is shown an exemplary patio enclosure, generally indicated at 10, constructed according to the present invention. The enclosure 10 is supported from below by a load-bearing substrate 12 and laterally by the exterior wall 14 of an existing structure, such as a house (not shown). The load bearing substrate 12 may be a concrete slab, wood decking, or the like.

Figure 1:
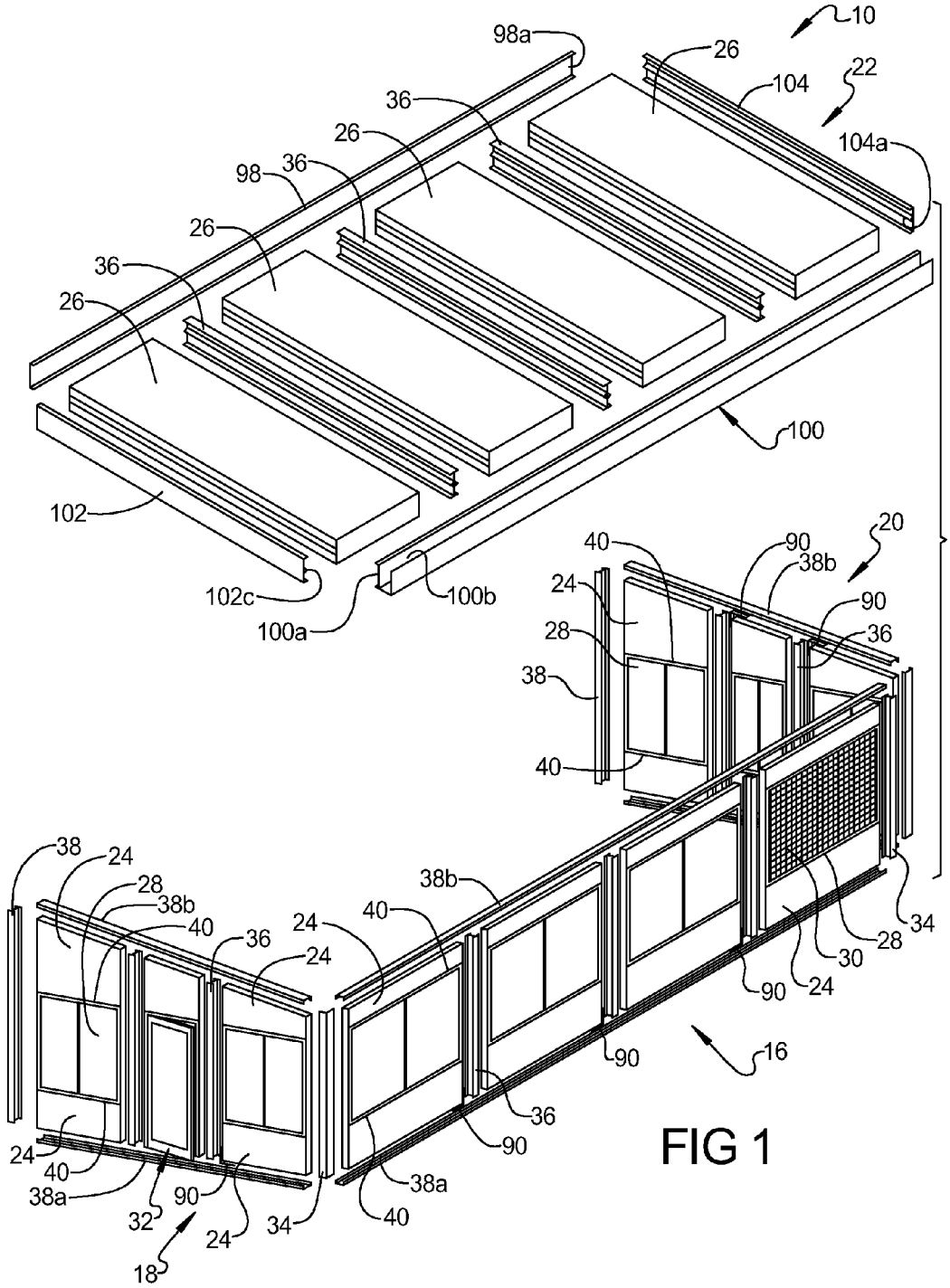
FIG. 1 is an exploded perspective view of a patio enclosure positioned for assembly using a variety of frame members and structural elements according to this invention.

As shown in FIG. 1, the enclosure 10 comprises a front wall 16, a pair of lateral side walls 18 and 20, and a sloping roof 22. The walls 16, 18 and 20 project upwardly from the substrate 12 where they are joined to the roof 22. The sidewalls 18 and 20 have opposite lateral ends connected, respectively, to the house and a respective lateral end of the front wall 16.

The walls and roof of the enclosure 10 are formed by a framework of joined horizontal and vertical structural members, such as structural filler wall panels 24 and roof panels 26, multiple pairs of sliding glass windows 28, framed screens 30 for each pair of windows (one shown), and an optional conventional door assembly 32.

Each wall panel 24 is generally rectangularly shaped and has a central body 24*a* of polymeric material, such as foam, and outer layers 24*b* and 24*c* wherein to provide a wall panel element of generally uniform thickness. The thickness of the wall panel 24 is such that the lateral edges thereof may be interfitted into the squared-C channel of a structural element according to this invention (described in detail below). Preferably, both of the layers 24*b* and 24*c* are clad with vinyl.

Preferably and according to this invention, certain of the structural elements used in this assembly are shown and identified on FIGS. 1A-1E. These structural elements include a corner post 34, a post or H-beam 36, a base track 38, a cross-beam channel 40, and a filler 44. As will be discussed below, nails, screws and like threaded fasteners, flanges and like connecting elements are used to connect the structural elements together and form modular wall portions and the patio enclosure 10.

Preferably and according to this invention, each of these structural elements are comprised of a composite PVC material and extruded into the desired cross-section and length. Subsequent to extrusion, a vinyl surface is clad to the exterior surfaces of the structural elements. The resulting element is sometimes referred to a composite PVC element. The structural elements made from the composite PVC material are generally stronger than wood, metal, or vinyl, has no adverse heat conduction, and has the durability of vinyl. Although extrusion is a preferable method, these elements may be injection molded.

According to one aspect, the composite material is comprised of a bound together mixture of cellulosic material (esp. sawdust or like finely pulverized dried wood, such as wood flour) and baking flour (e.g., the fine powdery foodstuff obtained by grinding and sifting the meal of a grain, especially wheat, used chiefly in baking). Suitable woods for sawdust are resin-free softwoods such as pine, fir and spruce, and to a lesser extent, hardwoods. The percentage of sawdust to baking flour, measured by weight or volume, and a binder and/or mixer ingredient used to hold the composition together is determined, in part, on a cross-section property of the structural element that is desired (i.e., thickness and area moment of inertia of the cross-section).

Figure 1A:
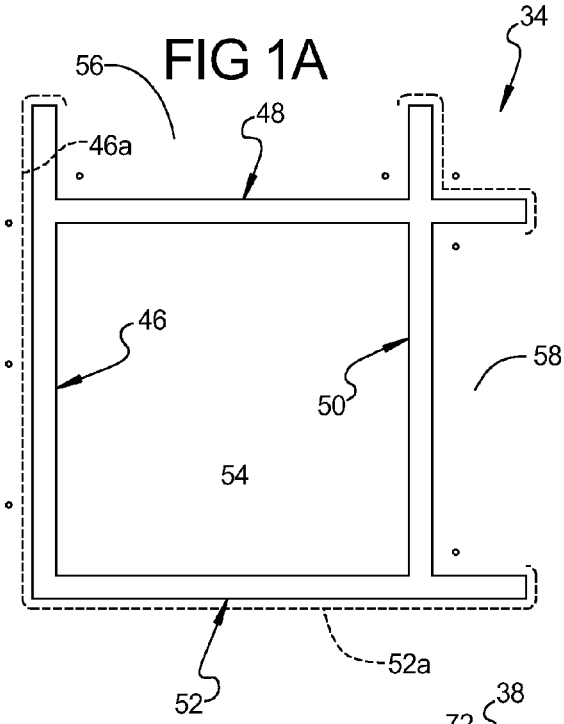
FIGS. 1A-1E are cross-sectional views of structural elements used in assembling the enclosure of FIG. 1.

Referring to FIG. 1A, the corner post 34 is box-like, in cross-section, axially elongated, and formed by walls 46, 48, 50 and 52. The walls intersect with one another to form a square central opening 54 and outwardly open squared-C shaped channels 56 and 58 for receiving the lateral edge of a wall panel 24. The walls 46 and 52 form an exterior corner with the outwardly facing surfaces 46*a* and 52*a* thereof clad with vinyl.

Figure 1B:
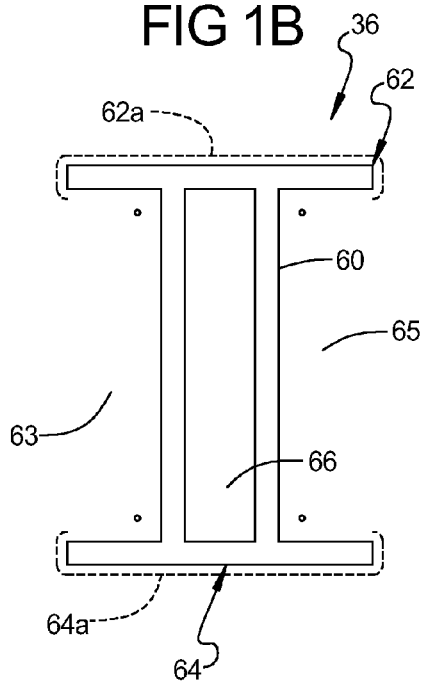

Referring to FIG. 1B, the post or H-beam 36 is axially elongated and includes a central body 60 and a pair of transverse flanges 62 and 64, which define oppositely facing squared-C shaped channels 63 and 65. The exterior surfaces 62*a* and 64*a* of the flanges 62 and 64 are clad with vinyl and the central body 60 is hollow and defines a central rectangular-shaped passageway 66.

Figure 1C:
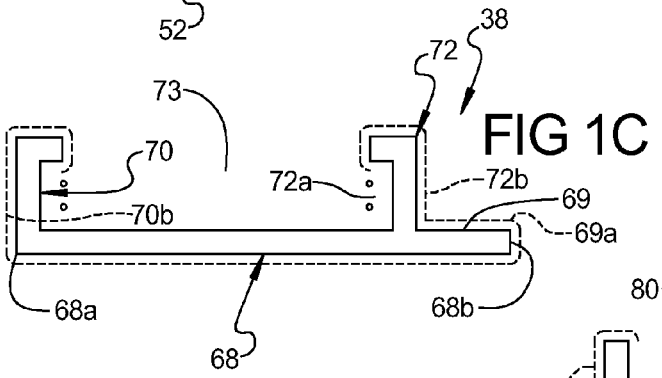

Referring to FIG. 1C, the base track 38 is axially extending and includes a flat base member 68 having opposite lateral edges 68*a* and 68*b* and a pair of opposed L-shaped arms 70 and 72, the arms being spaced apart and defining a track 73 therebetween. The L-shaped arms 70 and 72 are generally perpendicular to the plane of the base member 68 and define opposed squared-C shaped channels 70*a* and 72*a* that are in faced relation and communicate with the central track 73. The arm 70 extends along and upstands from the lateral edge 68*a* of the base member 68. The arm 72 extends along and upstands from the base member 68 at a location inwardly of the lateral edge 68*b* of the base member 68 wherein to define an offset base portion 69. The exterior surfaces 70*b*, 72*b*, and 69*a*, respectively, of the upstanding arms 70 and 72 and the offset base portion 69 are clad with vinyl.

Figure 1D:
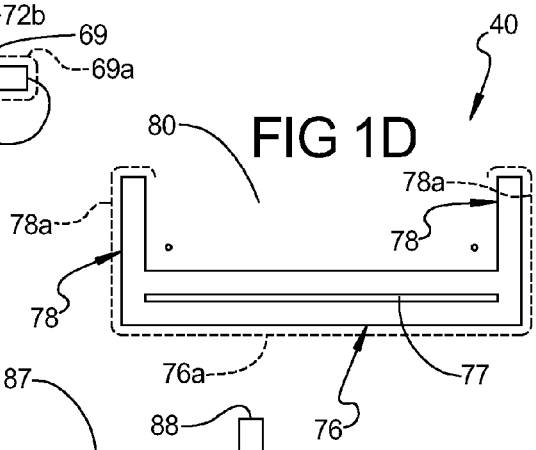

Referring to FIG. 1D, the cross-beam channel 40 is axially extending and forms a generally squared-C shape in cross-section. The channel 40 includes a base member 76 and a pair of opposed upstanding legs 78 wherein to define a squared-C shaped channel 80 having a width adapted to receive the lateral edge of a wall panel 24 interfitted therewithin. The base member 76 is hollow and defines a central rectangular shaped passageway 77. The exterior surface 76*a* and 78*a*, respectively, of the base member 76 and the legs 78 are clad with vinyl.

Figure 1E:
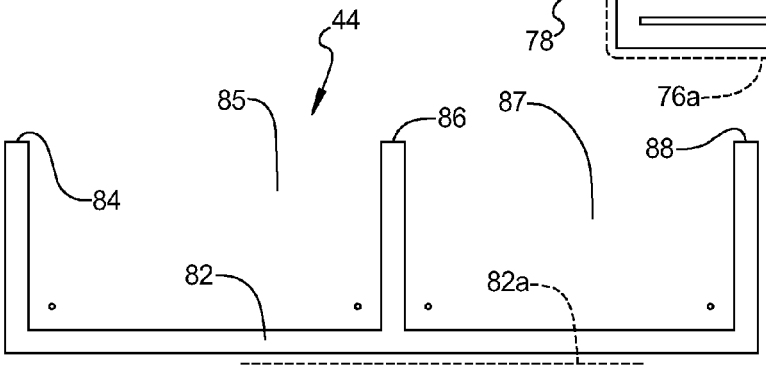

Referring to FIG. 1E, the filler 44 is axially extending and generally E-shaped in cross-section. The filler 44 includes a flat base 82 and three upstanding legs 84, 86, and 88, the legs 84 and 88 being outer legs and upstanding from the opposite respective lateral edges of the filler, and the leg 86 being a central leg upstanding from a central location of the base 82. The legs 84 and 86, and the legs 86 and 88, respectively, cooperate to form two squared-C shaped channels 85 and 87. The exterior surface 82*a* of the central base member 80 is clad with vinyl.

Figure 2:
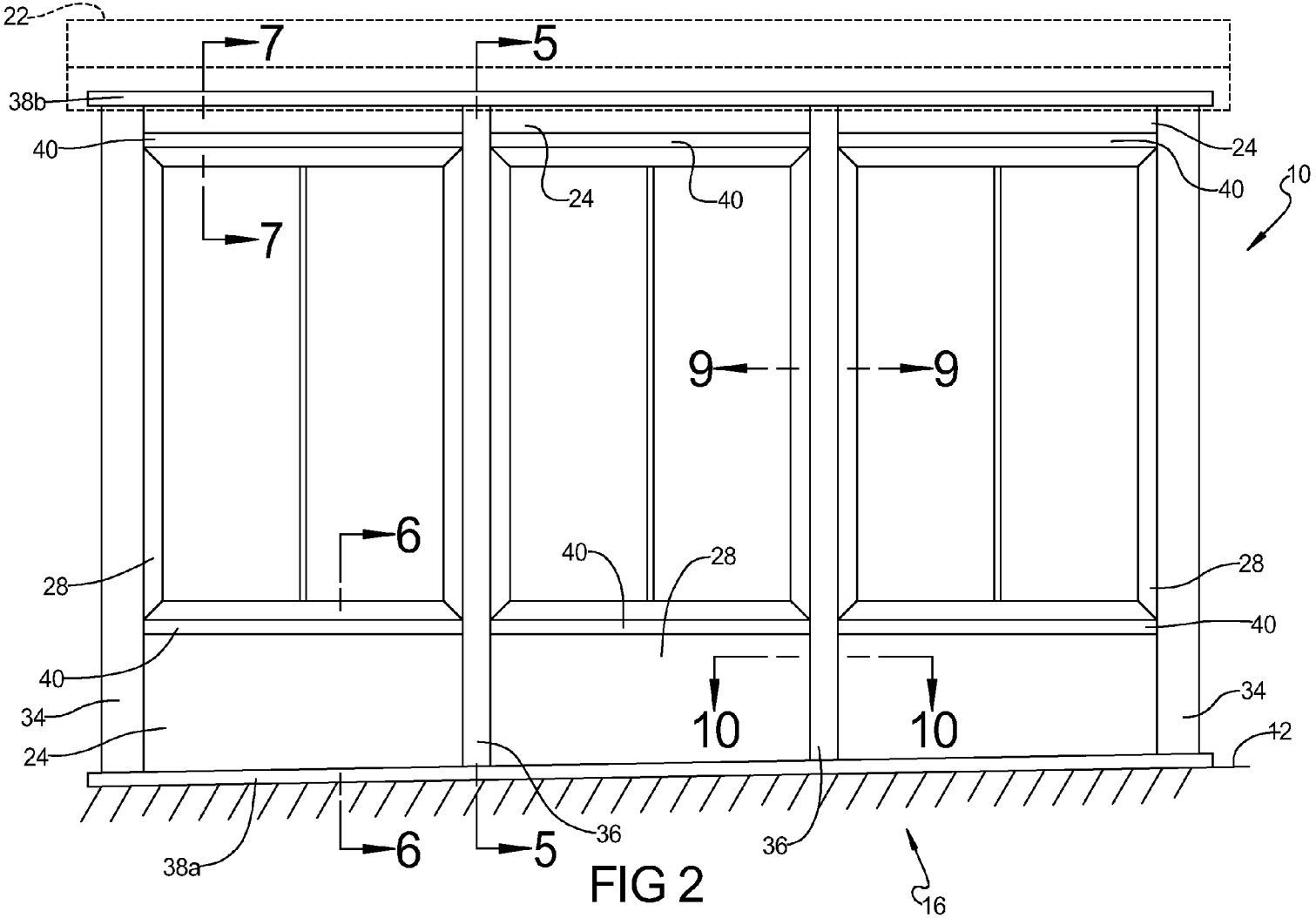
FIG. 2 is an elevation view showing the front side of the patio enclosure of FIG. 1, following assembly to an exterior wall of a house.
Figure 3:
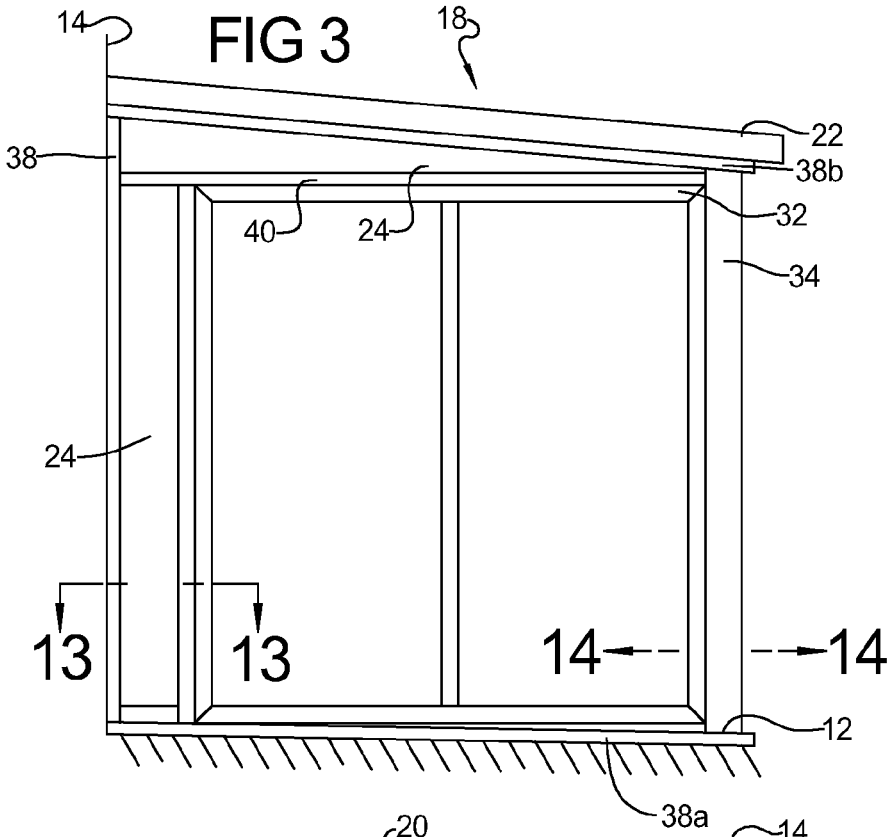
FIG. 3 is an elevation view showing the left side of the patio enclosure of FIG. 2.
Figure 4:
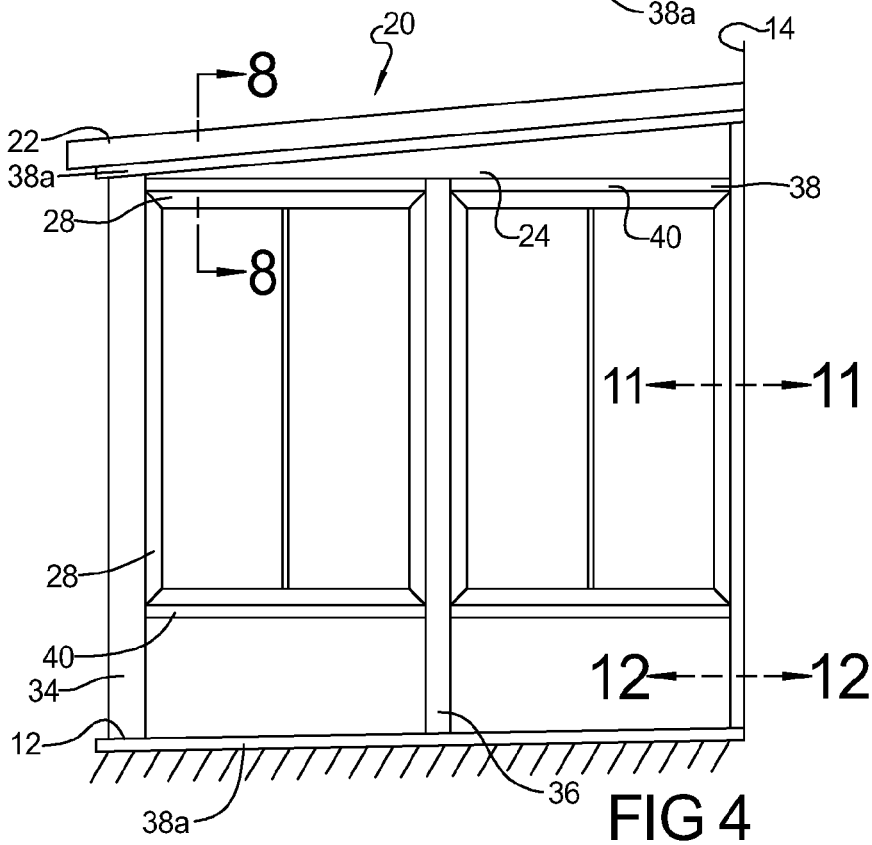
FIG. 4 is an elevation view showing the right side of the patio enclosure of FIG. 2.

As shown in FIGS. 1 and 2-4, the front, left, and right walls 16, 18 and 20 of the enclosure 10 are assembled by the formed by various of the structural elements 36, 38, 40, 42, and 44 and wall panels 24. As shown in FIG. 2, the front wall 16 is defined by and extends between two box-beams 34 and includes two H-beams 36 wherein to define three modular wall portions, each portion including a window framing 28 and wall panels 16. As shown in FIGS. 3 and 4, the left and right side walls 18 and 20 are defined by and extend between a box beam 34 and a base track 38. The right side wall 20 includes an H-beam 36 and defines two modular wall portions and the left side wall 18 includes optional door framing 32.

Figure 5:
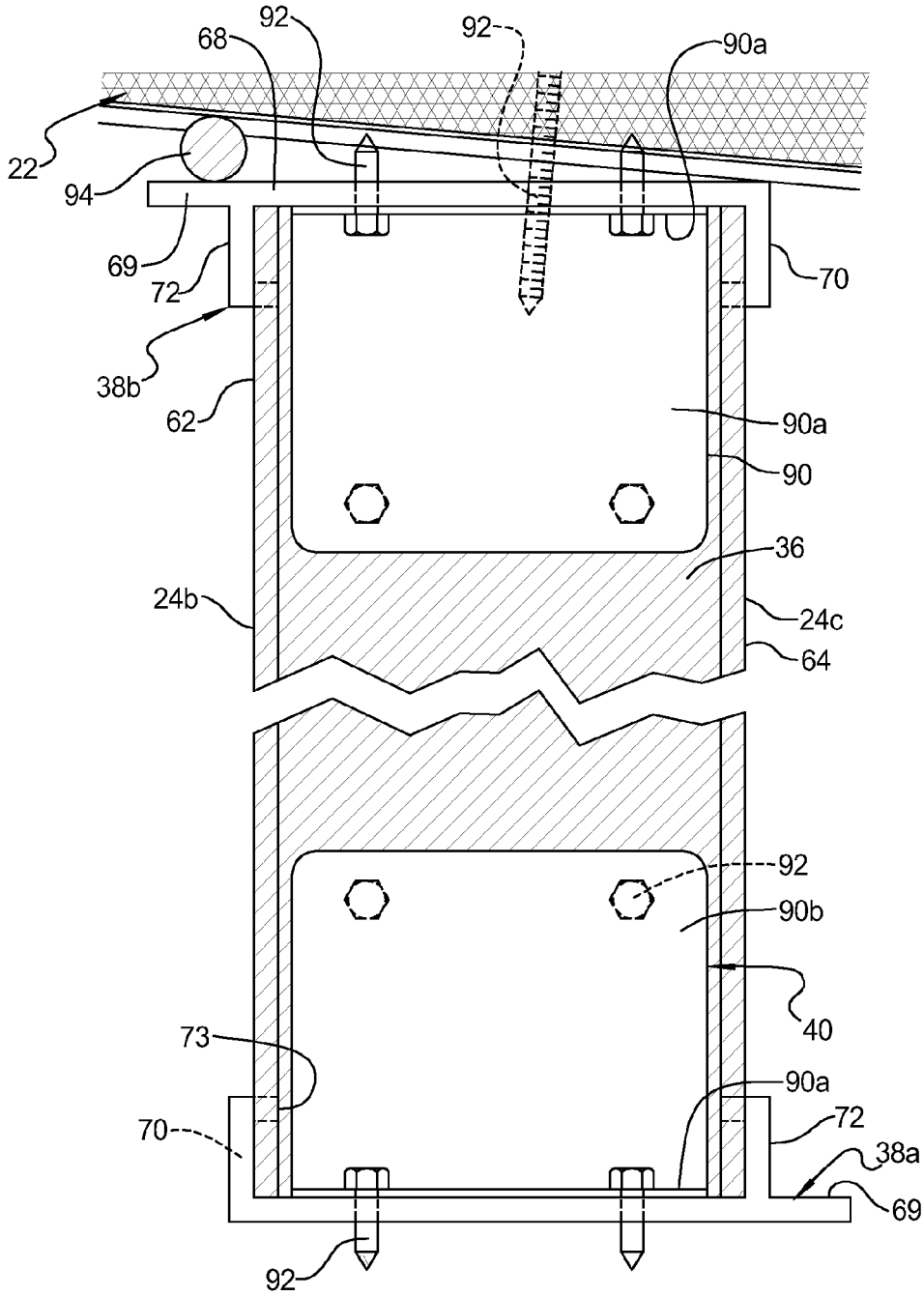
FIG. 5 is a section view of the front wall taken along line 5-5 of FIG. 2 showing an H-beam disposed vertically, C-shaped upper and lower track members disposed horizontally, L-shaped flanges securing the opposite ends of the beam to the track members, and connections that extend along the top and bottom ends of the front wall of the enclosure and connect the upper track member to the lower front end of the roof structure and the lower track member to the ground structure.

As shown in FIG. 5, the modular wall portion of the front wall 16 includes elongated lower and upper base tracks 38, denoted as 38*a* and 38*b* and disposed horizontally, and an H-beam 36 disposed vertically. L-shaped flanges 90 are secured at predetermined locations along the lower and upper base tracks 38*a* and 38*b* and serve to properly space and position the H-beams 36 and the corner box-beams 34 in a manner to receive wall panels 24, or door or window framing 28 and 32.

The lower base track 38*a* is positioned atop the substrate 12 and secured thereto by an L-shaped flange 90 and at least one threaded fastener 92. The flange 90 has opposite legs 90*a* and 90*b* and is nested in the track 73 formed between the opposed L-shaped arms 70 and 72 of the base member 68 with the flange leg 90*a* seated atop the base member 68 of the base track 38*a* and the flange leg 90*b* extending vertically upwardly from the base track. Fasteners 92 extend through the flange leg 90*a*, the base member 68, and into the substrate 12.

The upper track 38*b* forms the upward vertical extension of the front wall 24 and is secured, at least in part, to the upward vertical extension of the H-beam 36. As with the track 38*a*, the upper track 38*b* is provided with positioning flanges 90.

The lower and upper ends 36*a* and 36*b* of the H-beam 36 are nested into a respective track 73 formed between the opposed L-shaped arms of each respective track 38*a* and 38*b*. So positioned by the flanges 90 secured to the lower and upper tracks 38*a* and 38*b*, the flange leg 90*b* extending upwardly from the lower track 38*a* is threadably secured to the lower end portion of the H-beam, and the flange leg 90*b* extending downwardly from the upper track 38*b* is threadably secured to the upper end portion of the H-beam.

A wall panel 24 is inserted downwardly into the opposed squared-C channels of successive H-beams 36 or corner post 34 and H-beam 36. As can be seen in FIG. 5, the protective outer layers 24*b* and 24*c* of the panel 24 are generally coextensive (i.e., flush) with the outward extension of the flanges 62 and 64 of the H-beam 36.

The upper track 38*b* forms a closure cap and support for a forward lower front end of the roof structure 22. To provide support and sealing, an axially elongated, generally cylindrical strand 94 of elastomeric material is supported atop the upper track 38*b*, on the extended base portion 74 thereof, and supports and moisture seals the roof structure 22 of the enclosure 10.

Figure 6:
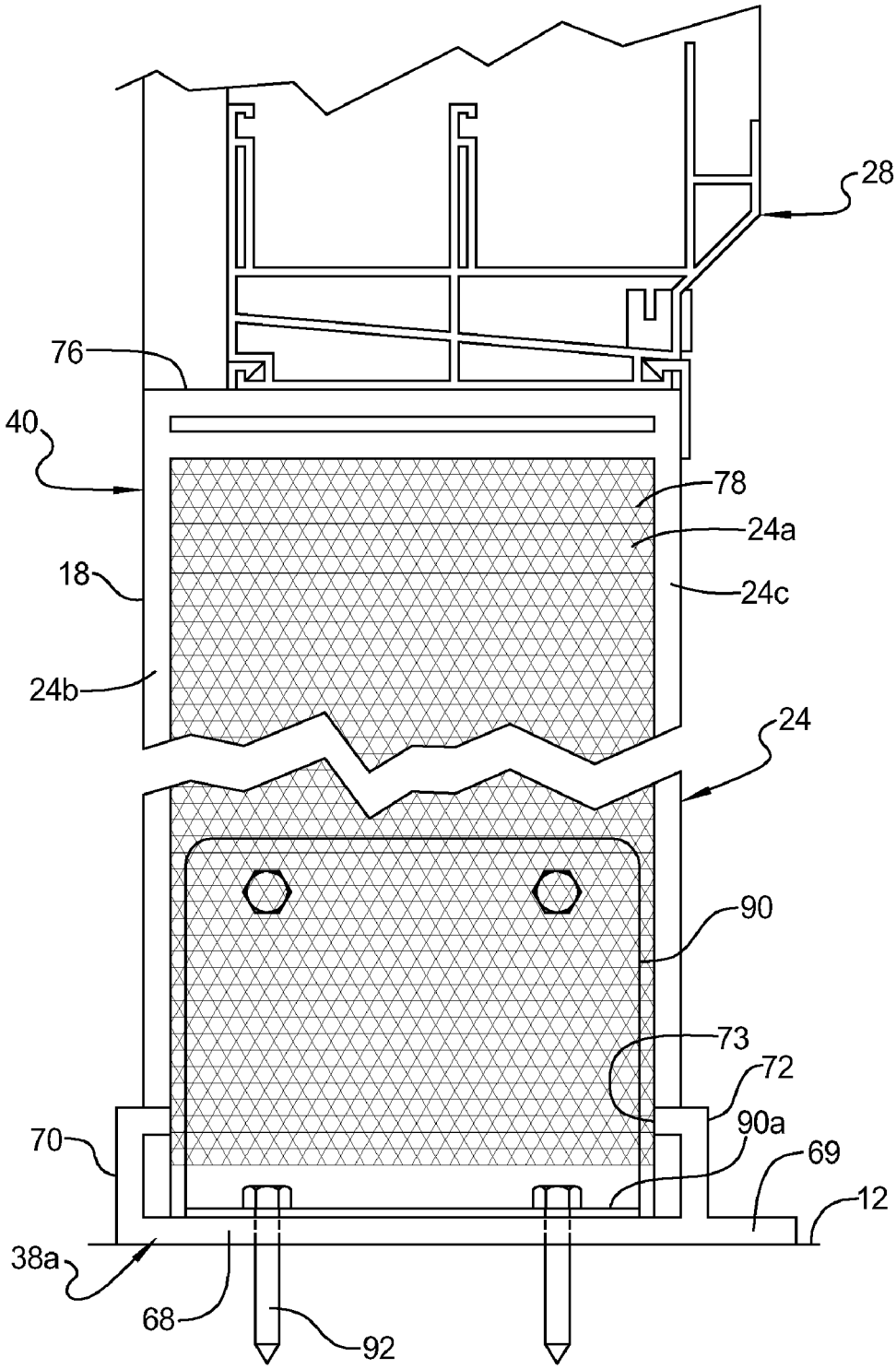
FIG. 6 is a section view of the front wall taken along line 6-6 of FIG. 2 showing a C-shaped channel member disposed horizontally, the bottom edge of a window channel supported on the channel member, the upper and lower edges of a front wall panel received in the channel member and lower track member, and a connection, which extends along and connects the front wall of the enclosure to the ground structure.

As shown in FIG. 6, a cross-beam channel 40 is interfitted onto and supported atop the upper lateral horizontally extending edge of the wall panel 24. Further, window framing 28 is thereafter supported atop the cross-beam channel 40.

Figure 7:
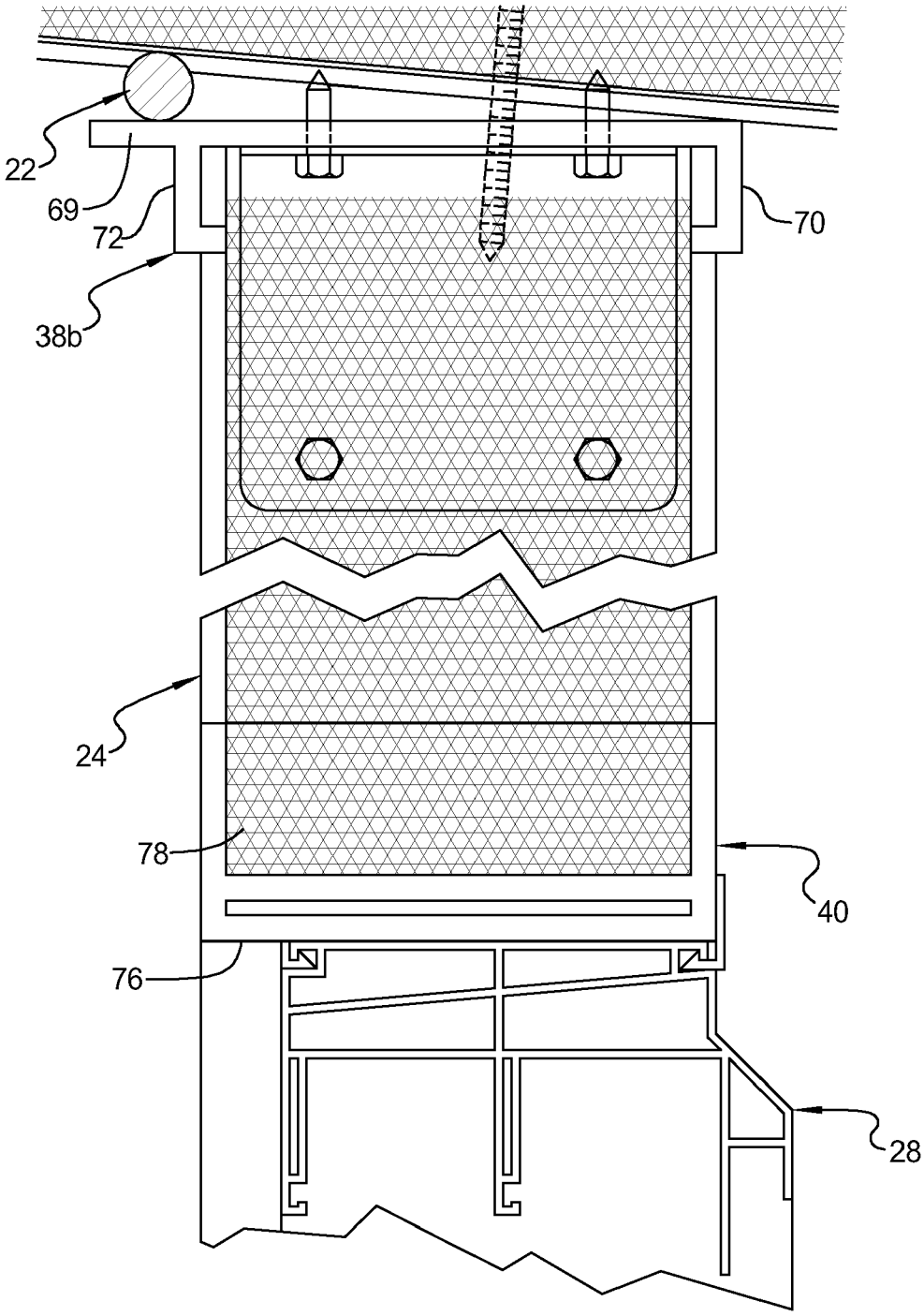
FIG. 7 is a section view of the front wall taken along line 7-7 of FIG. 2 showing the upper track member, the top edge of the window channel supporting a channel member, the upper and lower edges of a the front wall panel received in the upper track member and the channel member, and a the connection between the upper track member and the roof structure.

As shown in FIG. 7, a cross-beam channel 40 is interfitted onto the lower lateral horizontally extending edge of the wall panel 24. Further, window framing 28 is thereafter abutted against the cross-beam channel 40. In a manner described in connection with FIG. 5, the upper track 38*b* and strand 94 are shown in relation to the roof structure 22.

Figure 8:
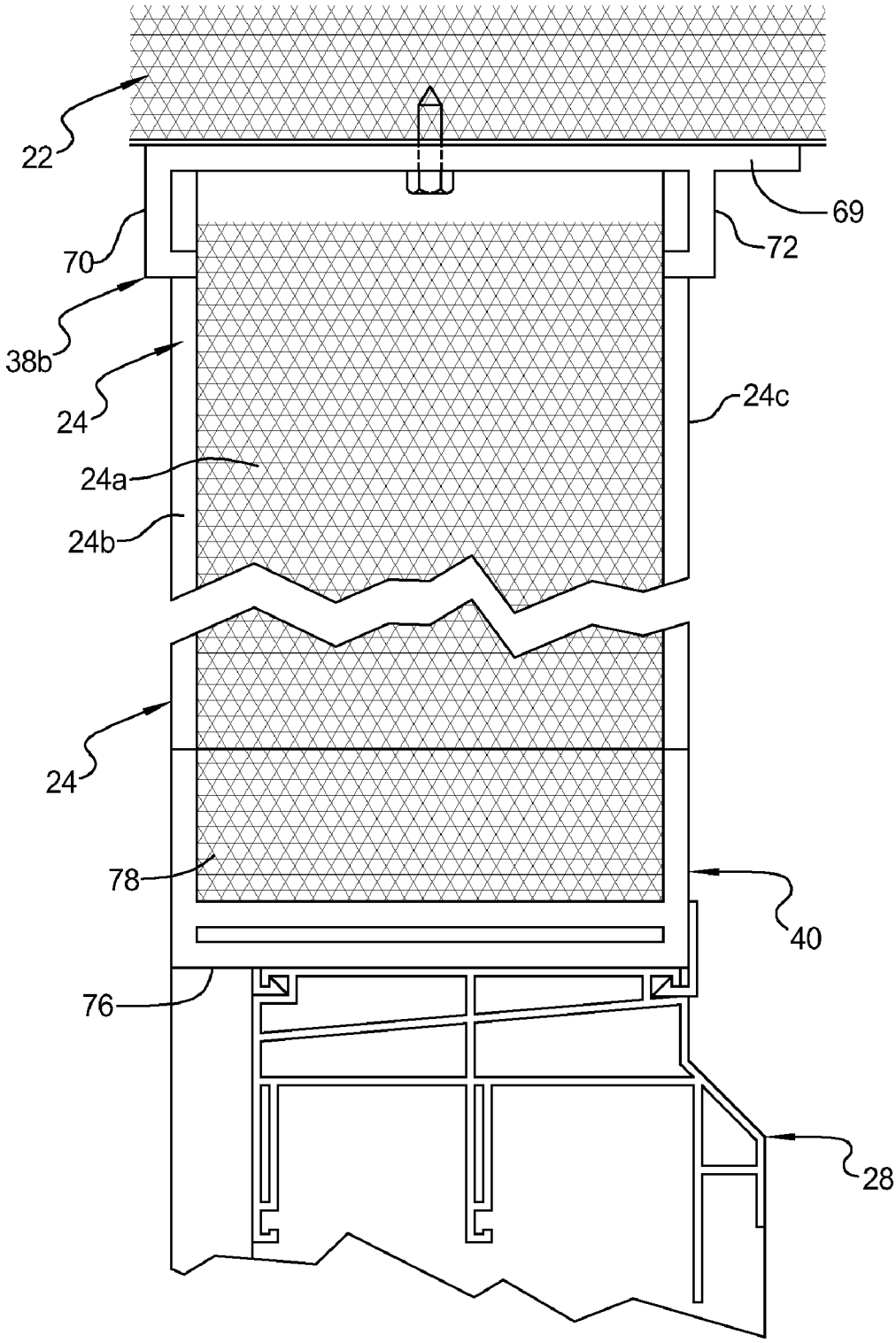
FIG. 8 is a section view of the right side wall taken along line 8-8 of FIG. 4 showing a channel member, the top edge of a window channel supporting the channel member, the upper and lower edges of a right side wall panel received in the upper and channel members, and a connection between the upper track member and the roof structure, which extends along and between the lower front and upper rearward end of the roof structure of the enclosure.

As shown in FIG. 8, the upper track 38*b* of the right wall 20 is shown supporting the roof structure 22. The right wall 22 includes an upper track 38*b*, a wall panel 24, and window framing 28. Because the upper end of the right wall 20 angles upwardly and is supporting relation with the bottom surface of the roof structure 22, the support strand 94 is not needed. Further, the base portion 74 extends in a direction outwardly of the enclosure 10.

As shown in FIG. 9, an H-beam 36 is shown separating two window framing sections 28, and L-shaped flanges 90 are connected to opposite sides of the central body 60 extending between the flanges 62 and 64 of the H-beam. Importantly, an E-shaped filler 44 is inserted into each of the two opposed squared-C channels 63 and 65 of the H-beam.

According to this invention, the cross-sections of the filler 44 and the squared-C channels 63 and 65 of the H-beam are such that the filler 44 forms, with the flanges and channels of the H-beam, a closure that makes the beam and filler elements appear as one unitary structure. That is, the base surface 82*a* of the filler 44 and the surfaces formed by the lateral edges of the respective flanges 62 and 64 are substantially coextensive with one another. The interfitment between the outer legs 84 and 88 of the filler 44 and the interior facing walls of the flanges 62 and 64 results in a snug frictional snap-fit interengegement.

As shown in FIG. 10, the opposed squared-C channels 63 and 65 of an H-beam 36 are shown receiving opposite respective lateral vertical edges of a respective pair of panels 24, and a flange 90 positioning the H-beam 36.

As shown in FIG. 11, a track 38 is disposed vertically and connected to the existing structure 14, and window framing 28 of the left side wall 18 is shown relative to the track.

Further and according to this invention, the cross-sections of a filler 44 and the central track 73 of a base track 38 are such that the filler 44 forms, with the central track 73, a closure that makes the two elements appear as one unitary structure. The interfitment between the outer legs 84 and 88 of the filler 44 and the interior facing ends of the L-shaped arms 70 and 72 of the base track 38 results in a snug snap-fit frictional interengagement.

As shown in FIG. 12, a base track 38 is threadably fastened to the exterior wall 14 and the vertical lateral edge of a wall panel 24 is interfitted within the track 73 formed between the opposed L-shaped arms 70 and 72 of the base track 38.

Figure 13:
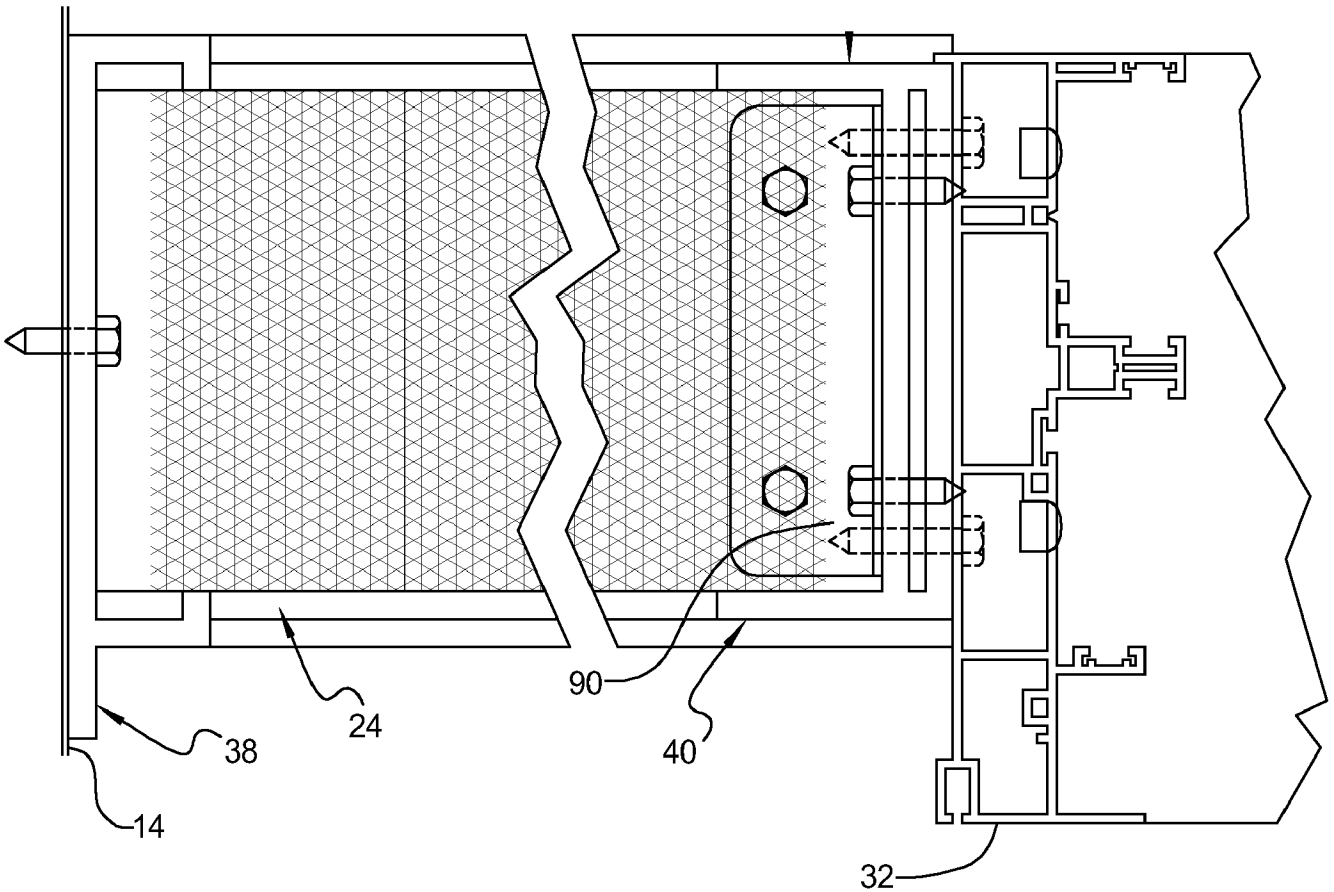
FIG. 13 is a section view of the left side wall taken along line 13-13 of FIG. 3 showing a C-shaped track member disposed vertically and connected to the exterior wall, a C-shaped track disposed vertically and connected by an L-shaped flange to the lower track, and thus to the ground structure, and a wall panel having opposite vertical edges interfitted into opposed channels of the track members.

As shown in FIG. 13, a base track 38, a wall panel 24, and a cross-beam channel 40 extend vertically upwardly from their connection to a horizontally extending lower base track (not shown). The opposite lateral vertically disposed edges of the wall panel 24 are interfitted within the central track 73 and squared-C channel 80 formed by the vertically disposed base track 38 and cross-beam channel 40. A flange 90 positions and secures the lower end of the cross-beam channel 40 relative to the lower base track. Further, the cross-beam channel 40 positions associated window framing 28.

Figure 14:
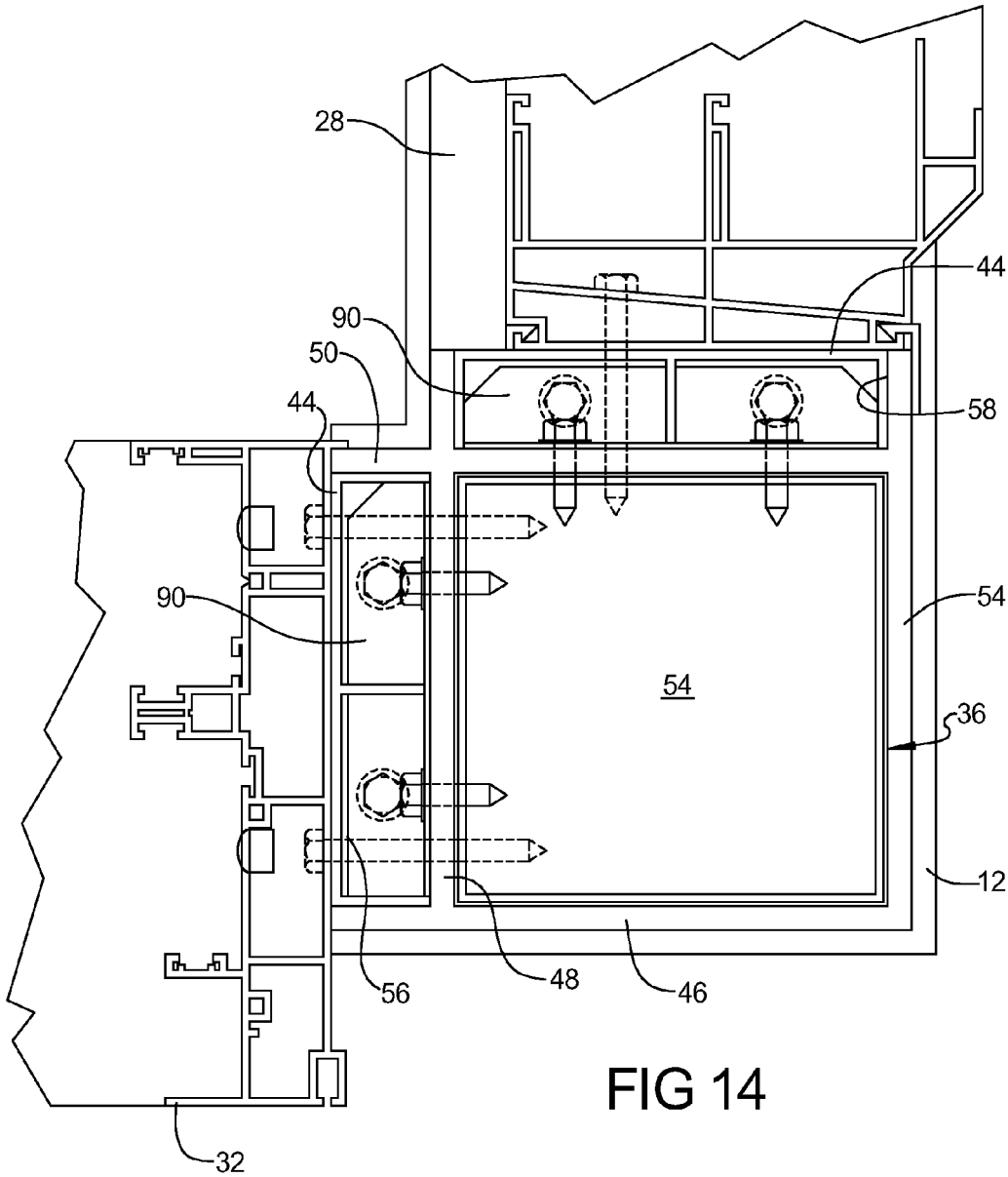
FIG. 14 is a section view taken along line 14-14 of FIG. 3 showing a box-shaped corner post having opposed channels for connecting the left and front wall panels to one another, and L-shaped flanges for connecting the corner post to a track member of the enclosure.

As shown in FIG. 14, a corner post 34 connects the vertical edges of the left and front walls 18 and 20. The corner post 34 extends vertically upwardly from the substrate 12 and is connected to two base tracks 38*a*, the base tracks extending horizontally along the substrate and at right angles to one another. The two base tracks 38*a* are connected to the substrate 12 by L-shaped flanges 90 in a manner described above. One L-shaped flange 90 is disposed in one base track 38*a* and has a vertical leg 90*a* received in the squared-C channel 56 and threadably fastened to the wall 48 of the corner post beam. The other L-shaped flange 90 is disposed in the other base track 38*a* and has a vertical leg 90*a* received in the squared-C channel 58 and threadably fastened to the wall 50 of the corner post beam.

An E-shaped filler beam 44 is snugly interfitted within the squared-C channels 56 and 58 wherein to provide the corner post 34 with a clean aesthetic appearance.

As shown in FIG. 1, the roof 22 is generally rectangularly shaped, angles downwardly from the exterior wall 14, and is generally coextensive with the front and side walls 16, 18 and 20 of the enclosure 10. The roof structure includes severally generally rectangularly shaped roof panels 26, a rearward channel bracket 98, a forward channel bracket 100, left and right end brackets 102 and 104, and a plurality of H-beams 36. The roof panels 26 are as described for the wall panels 24. Further, the channels 98 and 100 and end brackets 102 and 104 are comprised of a composite PVC, as described herein above.

The rearward channel bracket 98 is mounted to the exterior wall 14 and has an outwardly open channel 98*a* adapted to receive rearward lateral edges of the roof panels 26 and rearward end portions of the H-beams 36.

The forward channel bracket 100 has an outwardly open channel 100*a* adapted to receive forward lateral edges of the roof panels 26 and forward end portions of the H-beams 36. Further, the channel bracket 100 includes an upwardly open channel 100*b*, which forms a gutter or trough for directing water from the roof.

The left and right end brackets 102 ands 104 have outwardly open channels 102*a* and 104*a*, respectively, for receiving the lateral edge of a roof panel 26.

As assembled, the rear channel 98 is connected to the exterior wall 14. The rectangular roof panels 26 have their opposite longitudinal edge portions interfitted within the channel 63 and 65 of a respective H-beam 36, or left and right end bracket 100 and 102, and their opposite lateral edges ends interfitted within a channel 98*a* and 100*a* in the rearward and forward channel brackets 98 and 100. The opposite ends of the channel brackets 98 and 100 are connected to the opposite ends of the left and right end brackets 102 and 104.

As contemplated herein, the patio enclosure 10 may be advantageously supplied to the user in kit form, ready to go and for assembly to an existing structure. The kit for constructing an enclosure to the exterior wall of an existing structure would generally comprise the various structural elements as described in detail herein above.

In particular, the kit would comprise a plurality of wall panels 24 of predetermined height, width, and thickness, framing structure 28 and 32 for at least one window or door, a plurality of elongated track beams 38, the track beams forming upper and lower end caps of front and side walls 16, 18 and 20 formed by the kit, a plurality of vertical uprights 36 of H-shaped cross section, a plurality of corner posts 34, a plurality of C-shaped cross-beams 40, a plurality of closure members 44 of squared-C cross-section, the closure members being snap-fittable into a respective C-shaped channel provided in the H-beam and corner post, and fasteners 90 and 92 for positioning and securing the wall panels, framing structure, track beams, H-beams, corner posts, C-shaped cross-beams, and closure members to one another and the support structure.

Preferably, and according to this embodiment of the invention, the track beams, H-beam, corner-post, C-shaped cross-beam, and closure members of the kit are extruded or injection molded of a composite PVC, with predetermined exterior surfaces clad with a vinyl.

According to an alternate preferred embodiment of a room structure, as shown in FIGS. 15-21, various of the horizontal and vertical header and post beams of the patio enclosure 10 of FIG. 1 are modified and configured to define passageways through which electrical service wires may be passed. One end of each wire, respectively, is connected to a supply source, such as a terminal or fuse box of the building to which the room structure is attached as a build on, the wire passed through a modified header beam extending horizontally, vertically downwardly and through a modified post beam, and the other end connected to an outlet at the lower end of the post beam. The connection of the wire ends to the fuse box and outlet are not shown herein as being conventional and known to those skilled in the art.

The outlet may take different forms, such as for completing electrical connection with a standard electrical connector for passing electricity, or phone and/or cable interconnection, and/or a switch. Also, the outlet may be available inside or coverable with a plate and accessible for use both within and outside of the enclosure.

Several wires may be passed through the header and post beam structures. These wires may be separated or branched off and directed through one or more of the vertical post beams to supply electrical service to all parts of the room structure.

While described in the context of supplying electricity to the enclosure, the wire could also be for providing electrical connection with a television and/or cable service, comprise a telephone line, or a switch for completing an interconnection to turn on yet another service. The electrical outlet and/or switch may be protectively covered from the elements or accidental touching by children and accessible for use both interiorly or exteriorly of the enclosure.

Figure 15:
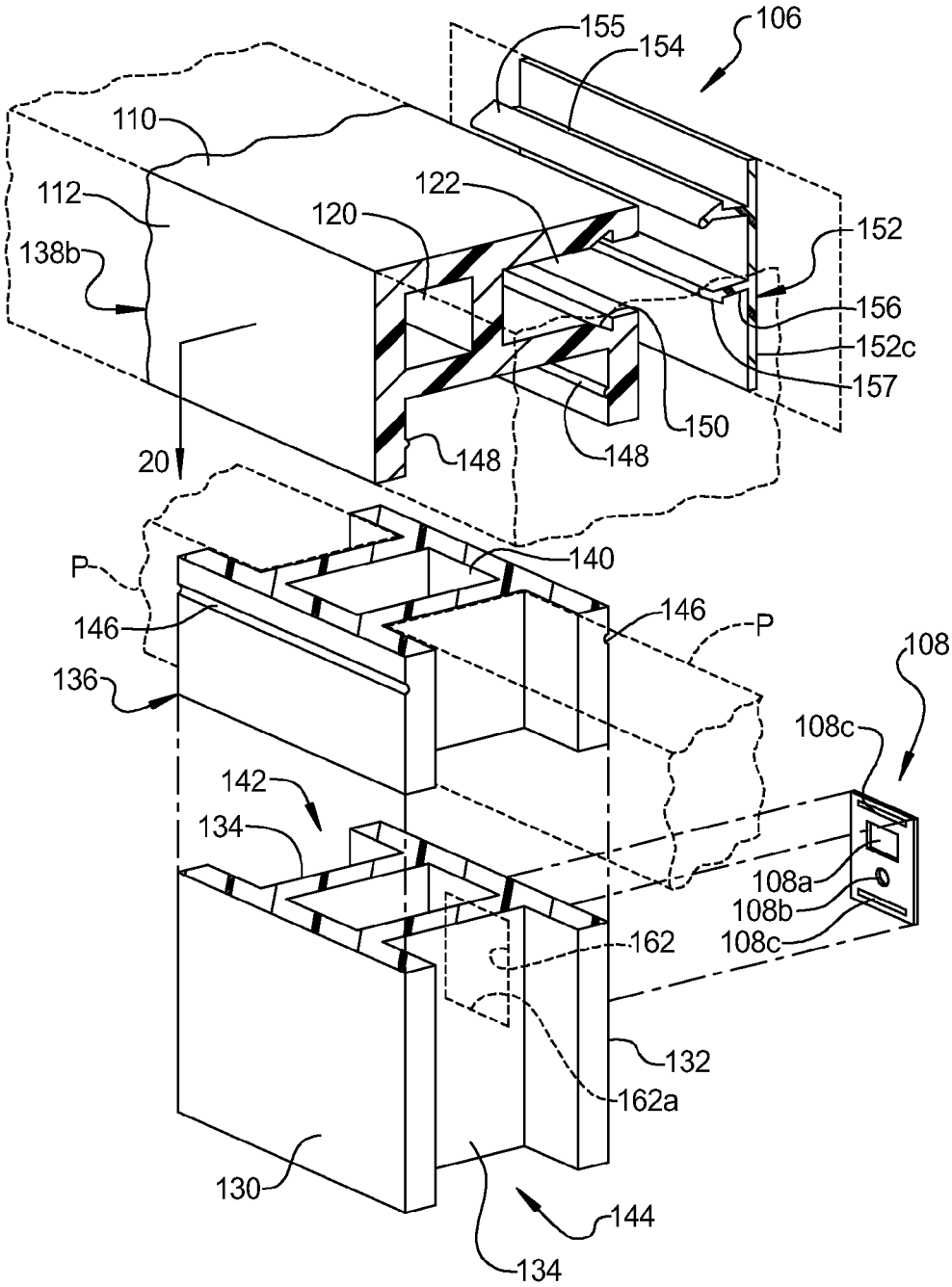
FIG. 15 is an exploded perspective assembly view of another preferred embodiment according to this invention wherein the header and post beams of the enclosure of FIG. 1 are modified and cooperate with a removable closure cover and cover plate to provide an accessible raceway and electrical services to the enclosure.

Turning to the drawings, FIG. 15 is an enlarged view of a portion of the enclosure 10 wherein the horizontally extending lower and upper header beams 38*a* and 38*b* are modified, and identified by the reference numbers 138*a* and 138*b*, and at least one of the vertically extending post beams 36 is modified, and identified by the reference number 136. The post and header beams 136 and 138*b* are similar to the beams 36 and 38*b* shown in FIG. 1 in that each is longitudinally elongated and of uniform cross-section between the opposite ends thereof. As will be described herein below, one or more wires "W" pass from the house, horizontally and through the upper header beam 138*b*, and vertically downwardly and through the upper end portion of a vertical post beam 136.

The horizontally extending lower header beam 138*a* may be modified in a manner like the upper header beam 138*b* and connect in like manner to the lower end of the post beam 136.

FIG. 15 illustrates a medial portion of the header beam 138*b* positioned for assembly atop the top vertical end portion of the post beam 136, a cover plate 106 positioned for removable connection to the header beam 138*b*, and an outlet plate 108 positioned for removable connection to a lower end portion of the post beam 136 and access to the lower end portion of a wire "W". The medial portion of the header beam 138*b* is shown partially in section and disposed generally horizontally with the dashed lines representing the longitudinally extending portions thereof. The post beam 136 is shown interfitted with rectangular wall or panel sections "P" (shown by the dashed lines).

Referring to FIGS. 15 and 16, the header beam 138*b* comprises an array of generally planar rectangular shaped wall elements 110, 112, 114, 116, and 118. The wall elements are generally at right angles to one another. The wall elements 110 and 112 are at right angles to one another with the wall element 110 being disposed horizontally and the wall element 112 being disposed vertically. The wall elements 110 and 114 extend generally at right angles from the wall element 112 and are in generally parallel relation to one another. The wall element 116 is at right angles to and extends vertically between the wall elements 110 and 114. The wall elements 118 and 112 extend generally at right angles to the wall element 110.

Further, the wall elements 110-118 cooperate to form a closed box chamber 120, the wall elements 110, 116 and 114, in part, form a U-shaped channel 122, and the wall elements 112, 114 and 118, in part, form a U-shaped channel 124. The box chamber 120 extends between the opposite longitudinal ends of the header and preferably is filled with thermal insulation material 126. The channel 122 is positioned to open interiorly of the enclosure and adapted to form, with the removable cover plate 106, a closed raceway 128 for passing wires. The channel 124 is adapted receive and seat atop the post beam.

Referring to FIGS. 15 and 17, the vertically extending post beam 136 is generally "H" shaped, longitudinally extending, and comprises a pair of generally planar, parallel, rectangular shaped wall elements 130 and 132 and a pair of wall elements 134 that are at right angles to and extend between the wall elements 130 and 132. The wall elements 130, 132, and 134 form, in part, a closed central box chamber 140 and a pair of outwardly opening U-shaped channels 142 and 144. The channels 142 and 144 are sized to receive a vertical edge of a rectangular wall or panel section "P" (shown by the dashed lines in FIG. 15).

Further, according to this invention, the connection between the post and header beams 136 and 138*a* and/or 138*b* is by a snap fit interconnection. In this regard the outer surfaces of the wall elements 130 and 132 of the post beam(s) 136 are provided with a respective transversely extending groove 146 and the inner surfaces of the wall elements 112 and 118, which form the channel 124 of the header, are provided with a respective rib 148.

In use, the post beams 136 are vertically disposed and the upper and lower end portions thereof, respectively, connected to the horizontally disposed upper and lower header beams 138*b* and 138*a*. The panels "P" are interfitted such that their opposite vertical edges are interfitted within opposed channels 142 and 144 and their upper and lower horizontal edges interfitted within the headers.

The end portion of the post beam 136 is fitted into the channel 124 of the header beam 138*b* at a sufficient distance to cause the end of the post beam to seat against the wall element 114. Thereupon, the ribs 148 on the post beam 136 snap fit within a respective of the grooves 146 in the header beam and form an interlocked connection therewith.

Further and according to this preferred embodiment of the invention, an accessible concealed passageway is defined for passing wires, as described, through a header beam 138*a* and/or 138*b*, and routed through, at least in part, one or more of the vertical post beams 136.

According to this aspect of the invention, and referring to FIGS. 15, 16, 18 and 21, the cover plate 106 is adapted to be releasably connected to the wall elements 110 and 114 of the header beam 138*b* whereby to close the channel 122 and form therewith the accessible wire passageway 128. The wall elements 110 and 114 are generally parallel to one another and each includes a shaped lock recess 150. The lock recesses 150 are in juxtaposed mirror image relation with one another and extend in generally parallel relation between the opposite ends of the header.

Referring to FIGS. 18 and 19, the cover plate 106 comprises a generally planar longitudinally extending rectangular shaped plate 152 having exterior and outer surfaces 152*a* and 152*b* and a pair of resilient latch or locking fingers 154 and 156. The latch fingers 154,156 project outwardly from the upper half of the interior surface 152*b* and at a right angle thereto and terminate in a respective hook 155 and 157. The latch fingers 154,156 are in the form of a cantilever beam and adapted to flex relative to the plate 152. Preferably, the latch fingers 154,156 are generally flat and planar and extend in generally parallel relation to one another between opposite ends of the cover plate 106. Depending on the application, the latch fingers 154 and 156 may be other than integral and in one piece and be segmented and in sections.

FIG. 19 shows detail of the hook 155, with the hook 157 being a mirror image thereof. The hook 155 is disposed at an angle of about 26° to the latch finger 154 and defines a rearward angled abutment shoulder 159 disposed at about 80° to the finger 154. The lock recess 150 is complementary to engage with the hook 155 and the abutment shoulder 159 of the locking finger.

In use, the cover plate 106 is positioned against the inwardly facing side of the header beam 138*b* and the latch fingers 154 and 156 inserted into the channel 122, whereupon the hooks 155 and 157 engage the wall elements 110 and 114, causing the latch fingers 154 and 156 to deflect towards one another. Further insertion results in the hooks 155 and 157 being brought into register and engagement with the lock recesses 150. So fitted, the cover plate 106 is connected to the header, closes the channel 122 and forms the closed wire raceway 128.

The cover plate 106 is substantially coextensive with and forms an aesthetic cover for the header and the exterior surface of the wall element 118.

Further, the lower half of the cover plate 106 forms a resilient release mechanism or skirt 152*c* for assisting in removal of the cover plate. The skirt 152*c* is adapted to be pried upwardly, such as by the insertion of a tool "T" between the wall element 118 skirt 152*c* formed by the lower half of the plate 152, whereby to pop the cover plate 106 free from engagement and allow access to the passageway 128 for accessing, routing, repairing and passing wiring through the header 138*b* and respective of the vertical post beams 136.

Referring to FIG. 21, the tool "T" is shown as a screwdriver having a flat-headed end. The end of the screwdriver is inserted between the plate 152 and wall element 118 of the header 138*b*. As shown by the dashed lines, the skirt portion is flexed outwardly and away from the header, thus urging the hook 157 of the latch finger 156 from connection with the lock recess 150. in the wall element 114 Further force causes the cover plate 106 to pop out from the channel 122 and be removed from connection to the header.

The hooks 155 and 157 and lock recesses 150 could be reversed, wherein the hooks are on the wall elements 110 and 114 and the lock recesses are in the latch fingers 154 and 156.

Similarly, the ribs and grooves could be reversed, wherein the ribs 148 extend outwardly from the wall elements 130 and 132 of the post beam 136 and the grooves 146 are in the wall elements 118 and 112 of the header beam.

Further, an appropriate opening or cutout 160 is provided through the wall element 114 of the header beam 138*b*, the cutout being proximate to the inlet into the channel 122 and in that portion of the wall element 114 that is defined between the wall elements 118 and 116. The cutout 160 allows one or more wires W of a wiring bundle to be turned 90° relative to the passageway 128 and directed vertically downwardly and into and through the box chamber 140 of a post beam 136.

As shown in FIG. 20, two laterally spaced post beams (shown in dashed lines) are connected to the header beam and the wall element 114 of the header is provided with two laterally spaced cutouts 160*a* and 160*b*. Each cutout 160*a* and 160*b* is positioned for directing one or more wires into the box chamber 140 of a respective of the laterally spaced first and second post beams. As shown in phantom lines, a bundle of five wires passes through the channel 122, with three wires W2 of the bundle being routed through the outlet 160*a* and into the first post beam and two wires W1 of the bundle being routed through the opening 160*b* and into the second post beam.

Referring back to FIG. 15, one or more of the post beams 136 of the enclosure is provided with at least one opening 162 to provide access to the interior passage or box chamber 140 of the respective post beam 136 and access to the free ends of the wiring services routed thereto. Typically, the free end of the wiring terminates at an electrical apparatus, such as to provide connection to a plug-in electrical outlet, jacks for connection to music, cable and phone systems, or a switch, to name a few. The electrical apparatus is in an appropriate wiring box, which box is disposed in the interior chamber 140 of the post beam 136 and fixedly mounted to the inner surface thereof. The wire termination is not shown as being known.

The opening 162 is typically covered by an appropriate outlet plate 108 to protectively cover the electrical connections as well as improve the appearance of the outlet. As shown, the outlet plate 108 includes a "squared" access port 108*a* for connection to electrical wiring (such as conventional wire plug outlets) and a "round" access port 108*b* for connection to computer or cable type connections.

Preferably, the outlet plate 108 is connected to the post beam 136 in an aesthetic manner. According to this invention, the backside of the outlet plate 108 is provided with ribs 108*c*, which conform to and frictionally engage with edge surfaces 162*a* that define the shape of the outlet opening 162. The outlet plate 108 is releasably connected in a snap fit to the post beam 136 and avoids the use of unsightly screws that would be seen on the front side.

Preferably and according to this invention, each of these structural beams 136 and 138 are as described above. Briefly, each is comprised of a composite PVC material and extruded into the desired cross-section and length. Subsequent to extrusion, a vinyl surface is clad to the exterior surfaces of the structural elements. The composite material is comprised of a bound together mixture of cellulosic material, as described herein above. The cover plate 106 is entirely of a suitable polymeric material, and either integrally molded or formed by a suitable extrusion process.

While there have been illustrated and described particular embodiments of patio enclosure structure and arrangements according to this invention, it will be appreciated that numerous changes and modifications will occur to those skilled in the art, and it is intended in the appended claims to cover all those changes and modifications which fall within the true spirit and scope of the present invention.

What I claim is:

1. A room structure for attachment to the exterior wall of a building comprising at least one horizontally disposed header beam, at least one vertically disposed post beam, and at least one cover plate secured to the at least one header beam;

the header beam having unitary construction and comprising a first pair of legs forming a laterally extending first channel, a second pair of legs forming a downwardly extending second channel, and a header beam chamber having an enclosed cross-section and extending the length of the header beam, the first and second channels being at substantially right angles to each other, each leg from the first pair of legs having a lock recess on an interior surface facing the first channel, and each leg from the second pair of legs having a rib on an interior surface facing the second channel;

the post beam having unitary construction and comprising a pair of first wall elements at right angles to a pair of second wall elements, the first wall elements having a width greater than the second wall elements and extending laterally outwardly to form a third channel and a fourth channel, and a central box chamber extending the length of the post beam, at least one of the wall elements from the pair of first wall elements including an opening for receiving a wiring box, an outer surface of each of the first wall elements having a transversely extending groove, the post beam dimensioned for insertion into the second channel of the header beam and the grooves and ribs dimensioned for snap-fit connection with each other;

the at least one cover plate comprising a planar longitudinally extending plate having a pair of opposed resilient latch fingers extending along the plate, each of the latch fingers including a hook, the latch fingers and the respective hooks dimensioned for engagement with the lock recesses on the first pair of legs on the header beam, and the plate dimensioned to be coextensive with the header beam such that the cover plate extends to cover the adjacent leg from the second pair of legs; and wherein each hook is disposed at an angle of about 26° to the respective latch finger, and each hook includes a rearward angled abutment shoulder disposed at an angle of about 80° to the respective latch finger.

2. The room structure of claim 1 wherein the header beam chamber is filled with insulation material.

3. The room structure of claim 2 wherein the header beam and the post beam comprise a composite PVC material including an additive chosen from the group consisting of:

(a) a cellulosic material;

(b) a baking flour; and (c) admixtures thereof.

4. The room structure of claim 3 wherein the cover plate comprises a resilient polymeric material.

5. The room structure of claim 2 wherein the cover plate comprises a resilient polymeric material.

6. The room structure of claim 1 wherein the header beam and the post beam comprise a composite PVC material including an additive chosen from the group consisting of:

(a) a cellulosic material;

(b) a baking flour; and (c) admixtures thereof.

7. The room structure of claim 6 wherein the cover plate comprises a resilient polymeric material.

8. The room structure of claim 1 wherein the cover plate comprises a resilient polymeric material.

9. The room structure of claim 8 wherein the header beam chamber is filled with insulation material.

10. The room structure of claim 1 wherein the header beam chamber is filled with insulation material.

* * * * *